US005559535A

United States Patent [19]

Otsuka et al.

[11] Patent Number: 5,559,535

[45] Date of Patent: Sep. 24, 1996

[54] TEMPERATURE CONTROL OF INK-JET RECORDING HEAD USING HEAT ENERGY

[75] Inventors: Naoji Otsuka, Kawasaki; Hiromitsu Hirabayashi, Yokohama; Kentaro Yano, Yokohama; Kiichiro Takahashi, Yokohama, all of Japan

[73] Assignee: Canon Kabushiki Kaisha, Tokyo, Japan

[21] Appl. No.: 547,848

[22] Filed: Oct. 25, 1995

Related U.S. Application Data

[63] Continuation of Ser. No. 852,671, Mar. 17, 1992, abandoned.

[30] Foreign Application Priority Data

| | | | |
|---|---|---|---|
| Mar. 20, 1991 | [JP] | Japan | 3-057457 |
| Mar. 20, 1991 | [JP] | Japan | 3-057460 |
| Mar. 2, 1992 | [JP] | Japan | 4-044773 |

[51] Int. Cl.[6] ..... B41J 29/38

[52] U.S. Cl. ..... 347/14; 347/11

[58] Field of Search ..... 347/10, 11, 14, 347/17, 19, 185, 186

[56] References Cited

U.S. PATENT DOCUMENTS

| | | | |
|---|---|---|---|
| 4,313,124 | 1/1982 | Hara . | |
| 4,345,262 | 8/1982 | Shirato et al. | 347/10 |
| 4,459,600 | 7/1984 | Sato et al. | 347/47 |
| 4,463,359 | 7/1984 | Ayata et al. . | |
| 4,544,931 | 10/1985 | Watanabe et al. . | |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,860,034 | 8/1989 | Watanabe et al. . | |
| 4,910,528 | 3/1990 | Firl et al. . | |
| 5,109,234 | 4/1992 | Otis, Jr. et al. | 347/14 |
| 5,331,340 | 7/1994 | Sukigara | 347/14 |

FOREIGN PATENT DOCUMENTS

| | | |
|---|---|---|
| 0300634 | 1/1989 | European Pat. Off. . |
| 0333507 | 9/1989 | European Pat. Off. . |
| 0418818 | 3/1991 | European Pat. Off. . |
| 3545689 | 7/1986 | Germany . |
| 3612469 | 10/1986 | Germany . |
| 3-935661 | 5/1990 | Germany . |
| 58-187364 | 11/1983 | Japan . |
| 59-123670 | 7/1984 | Japan . |
| 59-138461 | 8/1984 | Japan . |
| 60-107368 | 6/1985 | Japan . |
| 61-092876 | 5/1986 | Japan . |
| 63-283965 | 11/1988 | Japan . |
| 2-162054 | 6/1990 | Japan . |
| 2-217268 | 8/1990 | Japan . |
| 3-024972 | 2/1991 | Japan . |

*Primary Examiner*—John E. Barlow, Jr.

*Attorney, Agent, or Firm*—Fitzpatrick, Cella Harper & Scinto

[57] ABSTRACT

According to this invention, upon execution of recording by ejecting an ink droplet from a recording head, a surrounding temperature sensor for measuring the surrounding temperature is provided to a main body side, and a change in temperature of the head is presumed from the past to the present time by calculation processing, so that optimal temperature control can be performed without arranging a head temperature sensor having a correlation with the head temperature. At this time, the ejection quantity can be stabilized by changing the pulse width of a driving signal on the basis of the presumed head temperature, and ejection can be stabilized by performing restoration processing.

48 Claims, 27 Drawing Sheets

$P_1$ : PRE-HEAT PULSE ($=T_1$) (PWM)
$P_2$ : INTERVAL ($=T_2-T_1$)
$P_3$ : MAIN HEAT PULSE ($=T_3-T_2$)
Vop : DRIVING VOLTAGE

| POWER RATIO(APPLIED ENERGY/UNIT TIME) | HEAD TEMP ΔT | | | | | | | | | | | | |
|---|---|---|---|---|---|---|---|---|---|---|---|---|---|
| | 0～2.5 | 2.5～5 | 5～9 | 9～13 | 13～17 | 17～21 | 21～25 | 25～29 | 29～33 | 33～37 | 37～41 | 41～45 | 45～49 |
| 0～10 | 0 | −0.005 | −0.010 | −0.018 | −0.025 | −0.030 | −0.038 | −0.050 | −0.063 | −0.075 | | −1.00 | |
| 10～20 | 0.005 | 0 | −0.004 | −0.009 | −0.015 | −0.023 | −0.030 | −0.040 | −0.052 | −0.065 | | −0.40 | |
| 20～30 | 0.008 | 0.004 | 0 | −0.004 | −0.008 | −0.014 | −0.022 | −0.030 | −0.041 | −0.055 | | −0.10 | |
| 30～40 | 0.015 | 0.008 | 0.004 | 0 | −0.004 | −0.008 | −0.014 | −0.022 | −0.030 | −0.045 | | −0.07 | |
| 40～50 | 0.025 | 0.014 | 0.008 | 0.004 | 0 | −0.004 | −0.008 | −0.014 | −0.022 | −0.035 | | −0.05 | |
| 50～60 | 0.035 | 0.022 | 0.014 | 0.008 | 0.004 | 0 | −0.004 | −0.008 | −0.014 | −0.025 | | −0.04 | |
| 60～70 | 0.045 | 0.030 | 0.022 | 0.014 | 0.008 | 0.004 | 0 | −0.004 | −0.008 | −0.015 | | −0.03 | |
| 70～80 | 0.055 | 0.041 | 0.030 | 0.022 | 0.014 | 0.008 | 0.004 | 0 | −0.004 | −0.008 | | −0.02 | |
| 80～90 | 0.065 | 0.052 | 0.040 | 0.030 | 0.023 | 0.015 | 0.009 | 0.004 | 0 | −0.005 | | −0.01 | |
| 90～100% | 0.075 | 0.063 | 0.050 | 0.038 | 0.030 | 0.025 | 0.018 | 0.010 | 0.005 | 0 | | −0.007 | |
| | | | | | | | | | | | | −0.005 | |
| 500% | 1.50 | 1.20 | 1.00 | 0.80 | 0.70 | 0.60 | 0.40 | 0.20 | 0.10 | 0.05 | 0.005 | | |
| | | | | | | | | | | | | | |

FIG. 14

TEMPERATURE CONTROL OF INK-JET RECORDING HEAD USING HEAT ENERGY

This application is a continuation of application Ser. No. 07/852,671 filed Mar. 17, 1992, now abandoned.

BACKGROUND OF THE INVENTION

1. Field of the Invention

The present invention relates to an ink-jet recording apparatus for performing a recording operation by ejecting an ink from a recording head to a recording medium, and a temperature control method of the ink-jet recording apparatus.

2. Related Background Art

Recording apparatuses such as printers, copying machines, facsimile apparatuses, and the like record an image consisting of a dot pattern on a recording medium such as a paper sheet or a plastic thin plate on the basis of image information.

The recording apparatuses can be classified into ink-jet type, wire-dot type, thermal type, laser beam type, and the like according to their recording systems. Of these apparatus, an ink-jet type apparatus (ink-jet recording apparatus) causes a recording head to eject a flying ink (recording liquid) droplet from an ejection port thereof, and attaches the ink droplet to a recording medium to perform a recording operation.

In recent years, a large number of recording apparatuses are used, and are demanded to satisfy requirements such as high-speed recording, a high resolution, high image quality, low noise, and the like. As a recording apparatus, which can satisfy these requirements, the above-mentioned ink-jet recording apparatus is known. In the ink-jet recording apparatus, since a recording operation is performed by ejecting an ink from a recording head, stabilization control of an ink ejection operation, and an ink ejection quantity, which is necessary for satisfying the above-mentioned requirements, is largely influenced by the temperature of the recording head.

For this reason, the conventional ink-jet recording apparatus adopts so-called closed-loop control, i.e., a method wherein an expensive temperature sensor is provided to a recording head unit, and based on the detected temperature of the recording head, the temperature of the recording head is controlled within a desired range or ejection restoration processing is controlled. As a heater for the temperature control, a heater member joined to the recording head unit, or an ejection heater is used in an ink-jet recording apparatus, which forms a flying droplet by utilizing a heat energy to perform recording, i.e., in an apparatus for ejecting an ink droplet by the growth of a bubble caused by film boiling of an ink. When the ejection heater is used, it must be energized to a temperature as low as a bubble non-forming temperature.

In particular, in a recording apparatus for obtaining an ejection ink droplet by forming a bubble in a solid or liquid ink using a heat energy, closed-loop temperature control is generally performed since ejection characteristics considerably change depending on the temperature of the recording head, as is conventionally known. Otherwise, a low-cost type printer, which completely ignores printing quality, density nonuniformity, and the like, and is used in a compact electronic calculator, can only be available.

However, with the advent of portable OA apparatuses represented by lap-top personal computers, a portable printer is also required to have high quality. As for portable printers, due to their compact design structures, an exchangeable cartridge type head, in which a head and an ink tank are integrated, is expected to become increasingly popular. In addition, the exchangeable cartridge type head is also expected to become popular from the viewpoint of maintenance due to the popularity of home/personal use wordprocessors, personal computers, and facsimile apparatuses.

In this case, however, since a temperature sensor, a heater, and the like for temperature control are incorporated in the exchangeable cartridge, the following drawbacks are posed.

(1) Variation in temperature control measurement value due to variation in temperature sensor Since exchangeable heads are expendable supplies, every time a head is exchanged, a sensor suffering from a variation in characteristics is connected when viewed from the printer main body side.

In a recording head for forming a flying droplet by utilizing a heat energy to perform recording, since an ejection heater is manufactured in a semiconductor process, it is indispensable to build a diode sensor for detecting the temperature of the recording head in the same process from the viewpoint of a decrease in cost. Since the diode sensor suffers from a variation in the manufacture, it does not have precision as high as a temperature sensor as a selected product. Thus, the surrounding temperatures measured by diode sensors in different manufacturing lots sometimes have a difference of 15° C. or more.

For this reason, in closed-loop temperature control using the temperature sensor of the recording head, a variation in temperature sensor of the recording head must be adjusted in an extra adjustment step, or after a temperature sensor, which is ranked by measurement, is attached to the main body, it is corrected by an adjustment switch, thus requiring troublesome adjustment operations.

These adjustment operations considerably increase manufacturing cost, and deteriorate operability. Also, an increase in signal processing amount due to these adjustment operations, and a large increase in processing amount of an MPU due to the closed-loop control itself impose heavy loads on the apparatus design of compact, portable type printer main bodies.

(2) Countermeasure against electrostatic noise

Since exchangeable heads are expendable supplies, a user repetitively attaches/detaches the head from the main body. For this reason, contacts of the main body apparatus side are always exposed.

Since the output from a temperature sensor is directly supplied from the exchangeable head to a circuit on a printed circuit board of the main body through a carriage and flexible wiring lines, a temperature measurement circuit is very weak against electrostatic noise. This weak point is enhanced since the housing of a compact, portable printer cannot have a sufficient shield effect.

Therefore, in a conventional temperature detection method, electrostatic shields and parts as a countermeasure against electrostatic noise must be added for only one temperature sensor, and a compact structure, a decrease in cost, and quality are considerably damaged.

(3) Time delay

The object of temperature detection of the recording head is to control the temperature of the recording head within a desired range, and to perform stabilization control of the recording ink ejection operation, and the ejection quantity, as described above. More specifically, temperature detection of the recording head means detection of the ink temperature on the ejection heater in a strict sense. However, since it is difficult to directly detect the ink temperature on the ejection heater, the temperature sensor is attached near the heater (or nozzle) (the mounting position of the temperature sensor will be described in detail later). In an ink-jet recording apparatus, since the heat conduction speed of a heater board is lower than the speed of a change in ink temperature near the ejection heater, a time delay from an actual temperature is generated even if the temperature of the head is continuously detected.

Since the above-mentioned control is to feed back a temperature detected by the temperature sensor to a heating amount by the heater, the time delay disturbs precise control.

(4) Temperature detection error

In temperature detection by the temperature sensor, a temperature may be erroneously detected due to a thermal flow or electrical noise input to the temperature sensor. In order to prevent this, a method of averaging several detection values of the head temperature, and determining an average value as a current head temperature is adopted. However, when several detection temperatures are averaged, the following problems are posed:

[1] dynamic changes in temperature of the recording head are averaged; and

[2] a time delay is generated between an actual temperature and a detection value. Thus, these problems disturb precise feedback control.

SUMMARY OF THE INVENTION

The present invention has been made to solve the above-mentioned problems, and has as its object to provide a recording apparatus, which can detect the temperature of a recording head without arranging a temperature sensor in the recording head.

It is another object of the present invention to provide a recording apparatus, which can stabilize the ejection quantity and the ejection operation without arranging a temperature sensor in a recording head.

It is still another object of the present invention to provide a recording apparatus, which can control the temperature of a recording head within a desired range when the printing ratio is changed.

It is still another object of the present invention to provide a recording apparatus, which can precisely detect the temperature of a recording head in real time, and can precisely feed back the detected temperature to a heating means to stabilize the ink ejection operation and the ink ejection quantity.

In order to achieve the above objects, according to the present invention, upon execution of a recording operation by ejecting an ink droplet from a recording head, a surrounding temperature sensor for measuring a surrounding temperature is provided to a main body side, and a change in temperature of a head from the past to the present time is presumed and that from the present time to the future is predicted both by calculation processing, so that optimal temperature control can be performed without arranging a head temperature sensor, or the like, which has a correlation with a head temperature. Briefly speaking, a change in temperature of the head is presumed or predicted by evaluating it using a matrix which is calculated in advance within a range of a thermal time constant of the head and an applicable energy.

At this time, on the basis of the presumed or predicted head temperature, the pulse width of a driving signal is changed so as to stabilize the ejection quantity, and restoration processing is performed to stabilize the ejection operation.

BRIEF DESCRIPTION OF THE DRAWINGS

FIG. 14 shows a temperature presumption·prediction table;

DETAILED DESCRIPTION OF THE PREFERRED EMBODIMENTS

Figure 1:
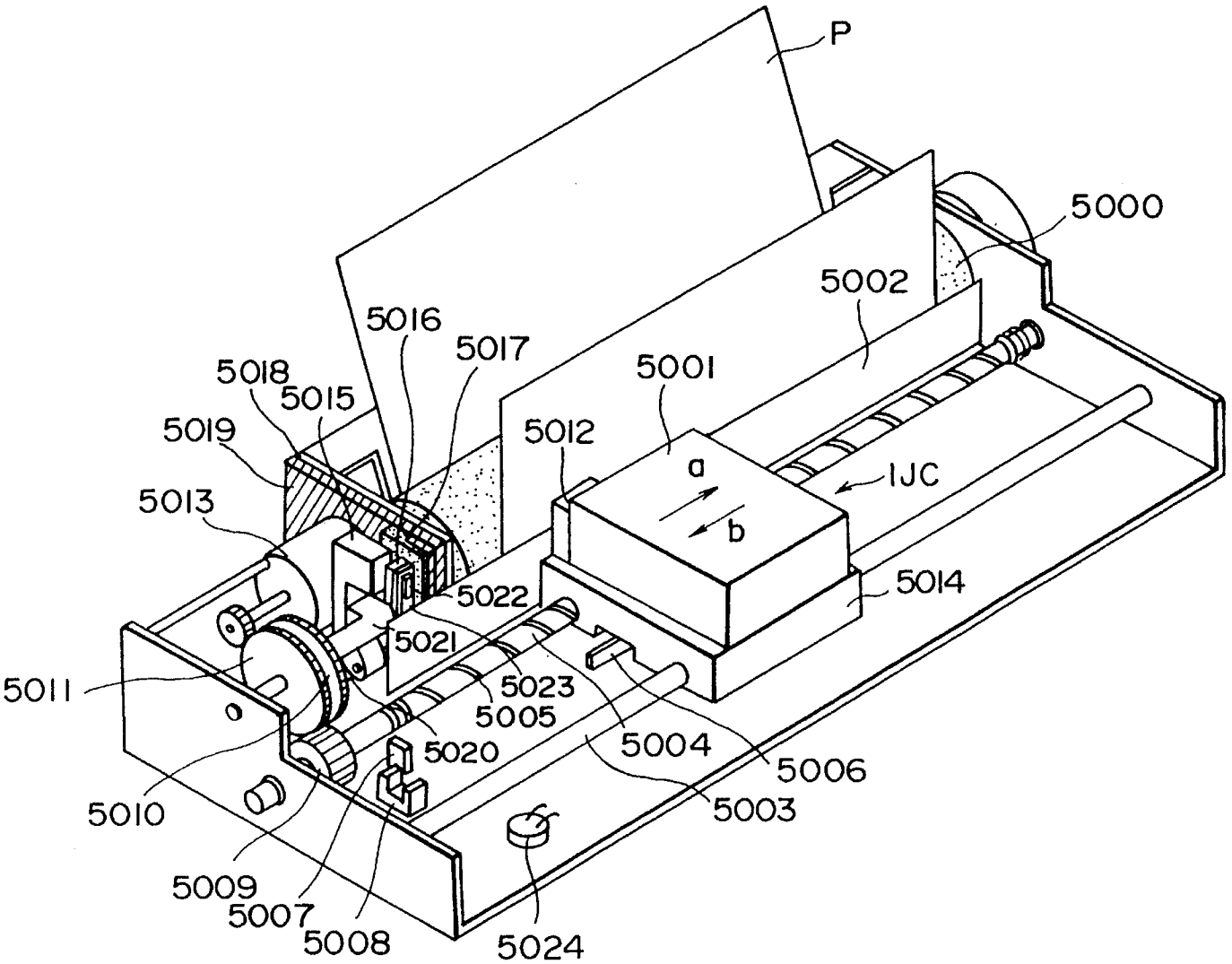
FIG. 1 is a perspective view showing an arrangement of an ink-jet recording apparatus in which the present invention is suitably practiced or applied.
Figure 2:
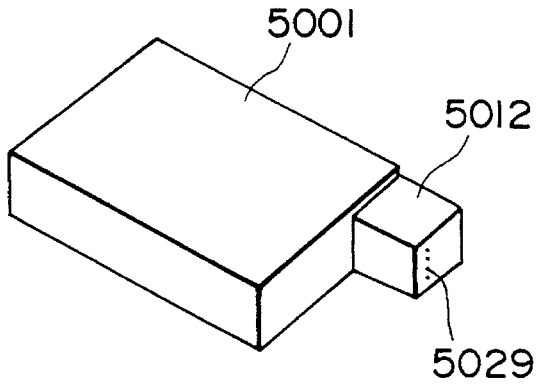
FIG. 2 is a perspective view showing an exchangeable cartridge.

The preferred embodiments of the present invention will be described below with reference to the accompanying drawings. FIG. 1 is a perspective view showing the arrangement of an ink-jet recording apparatus IJRA, in which the present invention is suitably practiced or applied. In FIG. 1, a recording head (IJH) 5012 is coupled to an ink tank (IT) 5001. As shown in FIG. 2, the ink tank 5001 and the recording head 5012 form an integrated exchangeable cartridge (IJC). A carriage (HC) 5014 is used for mounting the cartridge (IJC) to a printer main body, and is scanned in the sub-scan direction along a guide 5003.

A platen roller 5000 scans a printing medium P in the main scan direction. A temperature sensor 5024 measures the surrounding temperature in the apparatus. Note that the carriage 5014 is connected to a printed circuit board (not shown) comprising electrical circuits (e.g., the temperature sensor 5024) for controlling a printer through a flexible cable (not shown) for supplying a driving signal pulse current and a head temperature control current to the recording head 5012.

FIG. 2 shows the exchangeable cartridge. The cartridge has a nozzle portion 5029 for ejecting an ink droplet. The ink-jet recording apparatus IJRA with the above arrangement will be described in detail below. In the recording apparatus IJRA, the carriage HC is engaged with a spiral groove 5004 of a lead screw 5005, which is rotated through driving force transmission gears 5011 and 5009 upon normal or reverse rotation of a driving motor 5013. The carriage HC has a pin (not shown), and is reciprocally moved in directions indicated by arrows a and b. A paper pressing plate 5002 presses a paper sheet against the platen 5000 along a carriage moving direction. Photocouplers 5007 and 5008 serve as a home position detection means for confirming the presence of a lever 5006 of the carriage HC in a corresponding region, and, e.g., switching the rotational direction of the motor 5013. A member 5016 supports a cap member 5022 for capping the front surface of the recording head. A suction means 5015 draws the interior of the cap by vacuum suction, and performs a suction restoration operation of the recording head 5012 through an inner cap opening 5023.

A member 5019 allows forward/backward movement of a cleaning blade 5017. The member 5019 and the cleaning blade 5017 are supported on a main body support plate 5018. The blade of this embodiment is not limited to the cleaning blade 5017, but may employ a known cleaning blade. A lever 5021 is used for starting a suction operation of a suction restoration operation. The lever 5021 is moved upon movement of a cam 5020 engaged with the carriage HC, and is subjected to movement control based on a driving force from the driving motor through a known transmission means (by, e.g., switching clutches).

These capping, cleaning, and suction restoration operations can be performed at their corresponding positions by operation of the lead screw 5005 when the carriage HC reaches a home position region. However, the embodiment is not limited to this as long as desired operations are performed at known timings.

Figure 3:
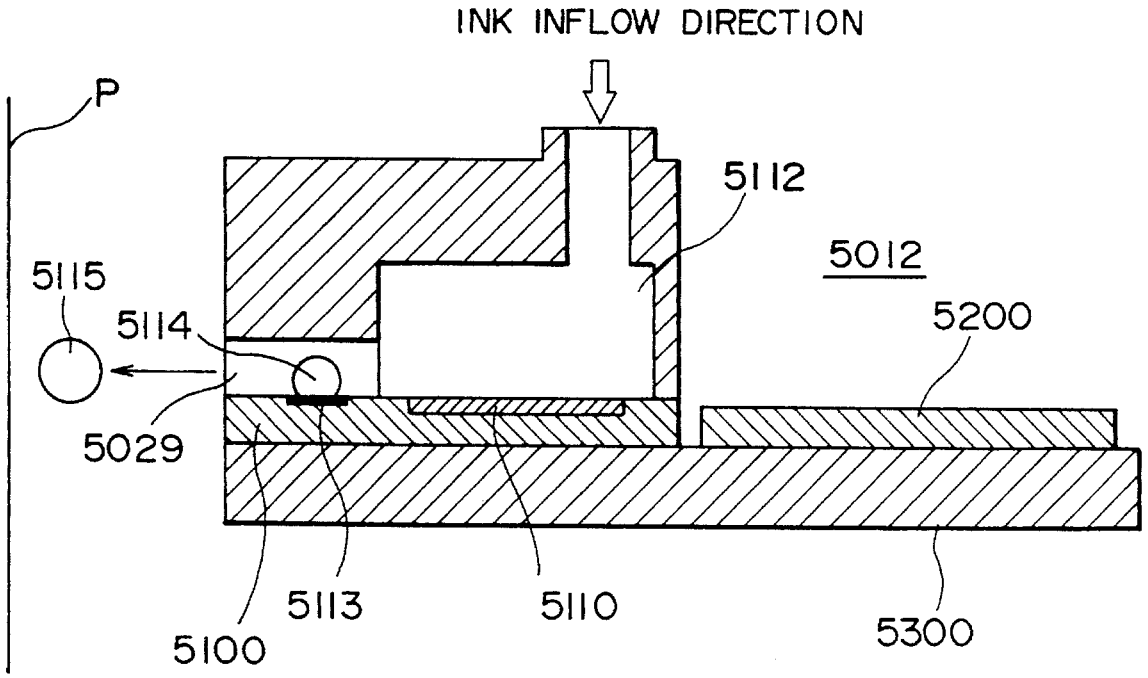
FIG. 3 is a sectional view of a recording head.

FIG. 3 shows in detail the recording head 5012. A heater board 5100 formed in a semiconductor manufacturing process is arranged on the upper surface of a support member 5300. A temperature control heater (temperature rise heater) 5110, formed in the same semiconductor manufacturing process, for holding and controlling the temperature of the recording head 5012 is arranged on the heater board 5100. A wiring board 5200 is arranged on the support member 5300. The wiring board 5200, the temperature control heater 5110, and an ejection (main) heater 5113 are connected through wiring lines (not shown) by, e.g., wire bonding. The temperature control heater 5110 may be prepared by adhering a heater member formed in a process different from the heater board 5100 onto the support member 5300, or the like.

A bubble 5114 is generated by heating by the ejection heater 5113. Ink is ejected as an ink droplet 5115. The head has a common ink chamber 5112 through which ink to be ejected flows into the recording head.

Figure 4:
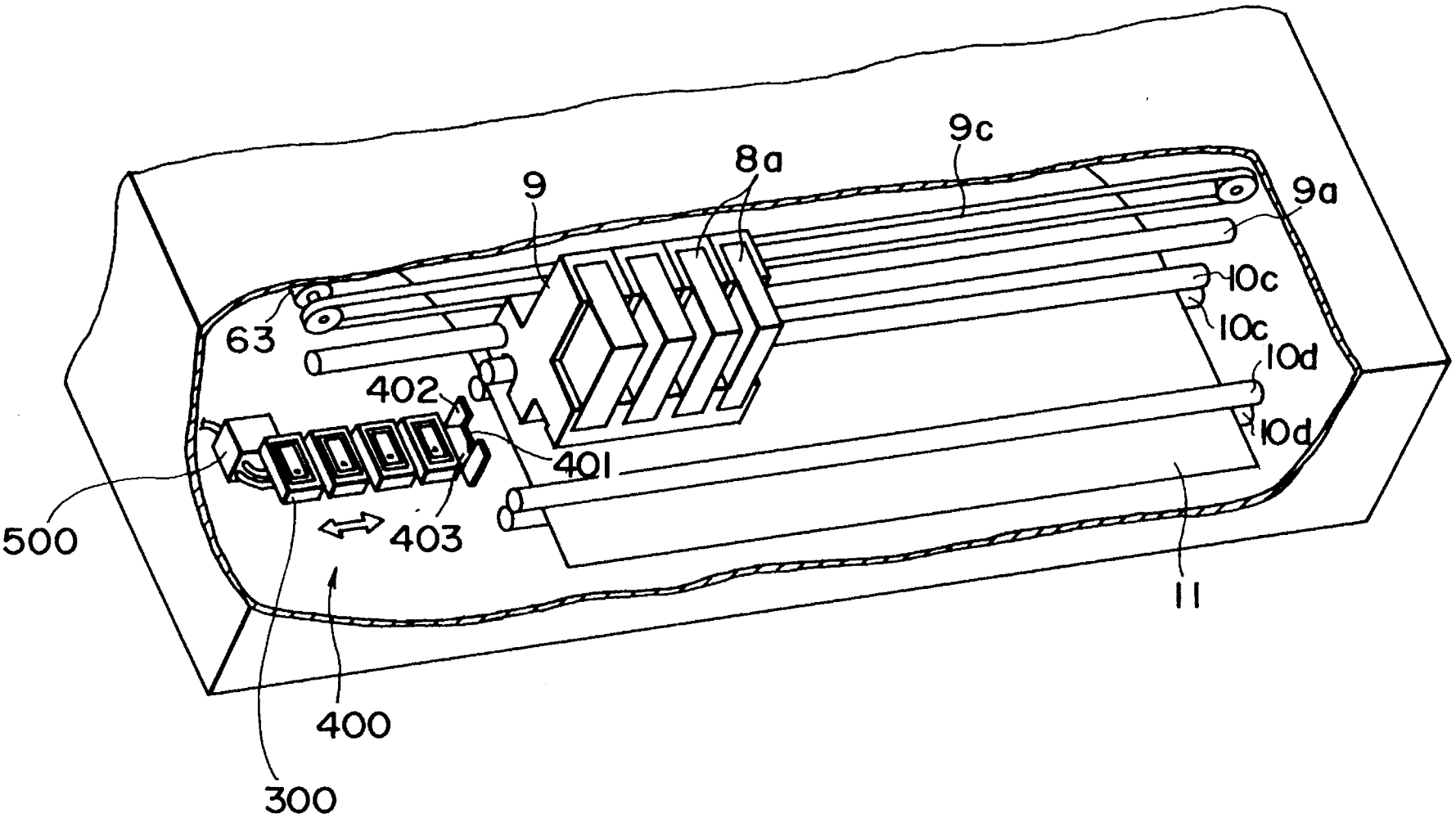
FIG. 4 is a perspective view showing a restoration system unit.

FIG. 4 is a schematic view of the ink-jet recording apparatus to which the present invention is applicable. In FIG. 4, each ink-jet cartridge **8*a* has an ink tank portion in its upper portion, and a recording head 8*b* (not shown) in its lower portion, and also has a connector for receiving a signal for driving the recording head 8*b*. A carriage 9 can align and mount four cartridges (which respectively store inks of different colors, e.g., black, cyan, magenta, yellow, and the like). The carriage has a connector holder for supplying signals for driving the corresponding recording heads, and the holder is connected to each of the recording heads 8*b***.

The apparatus includes a scan rail **9*a*, extending in the main scan direction of the carriage 9, for slidably supporting the carriage 9, a driving belt 9*c* for transmitting a driving force for reciprocating the carriage 9, a pair of convey rollers 10*c* and 10*d*, arranged in front of and behind the recording position of the recording head, for clamping and conveying a recording medium, and a recording medium 11 such as a paper sheet, which is urged against a platen (not shown) for regulating the recording surface of the recording medium 11 to be flat. The recording heads 8*b* of the ink-jet cartridges 8*a* mounted on the carriage 9 extend downward from the carriage 9, and are located between the recording medium convey rollers 10*c* and 10*d*, so that the ejection port forming surface of each recording head unit opposes parallel to the recording medium 11 urged against the guide surface of the platen (not shown). Note that the driving belt 9*c* is driven by a main scan motor 63, and the pair of convey rollers 10*c* and 10*d* are driven by a sub-scan motor 64** (not shown).

In the ink-jet recording apparatus of this embodiment, a restoration system unit 400 is arranged at the home position side on the left side in FIG. 1. The restoration system unit 400 includes cap units 300 arranged in correspondence with the plurality of ink-jet cartridges **8*a* each having a recording head 8*b*. The cap units 300 are slidable in the right-and-left direction in FIG. 4, and are vertically movable upon movement of the carriage 9. When the carriage 9 is located at the home position, the cap units 300 are coupled to the corresponding recording heads 8*b* to cap them, thus preventing an ejection error, which occurs when an ink in the ejection port of each recording head 8*b*** becomes highly viscous and sticks to the port upon evaporation.

The restoration system unit 400 also includes a pump unit 500 communicating with the cap units 300. The pump unit 500 is used for generating a negative pressure in suction restoration processing, which is performed by coupling the cap units 300 and the recording heads **8*b* when the recording heads 8*b* suffer from an ejection error. Furthermore, the restoration system unit 400 includes a blade 401 as a wiping member formed of an elastic member such as rubber, and a blade holder 402 for holding the blade 401. Reference numeral 403** denotes an absorber.

The four ink cartridges mounted on the carriage 9 use a black ink (to be abbreviated as K hereinafter), a cyan ink (to be abbreviated as C hereinafter), a magenta ink (to be abbreviated as M hereinafter), and a yellow ink (to be abbreviated as Y hereinafter), and inks overlap in this order. Intermediate colors can be realized by properly overlapping C, M, and Y ink dots. More specifically, red can be realized by overlapping M and Y; blue, C and M; and green, C and Y. Although black can be realized by overlapping three colors C, M, and Y, since color development of black at that time is poor, and it is difficult to precisely overlap three colors, a chromatic color edge is undesirably formed, and the ink ejection density per unit time becomes too high. Thus, only black is separately ejected (black ink is used).

(Control Arrangement)

Figure 5:
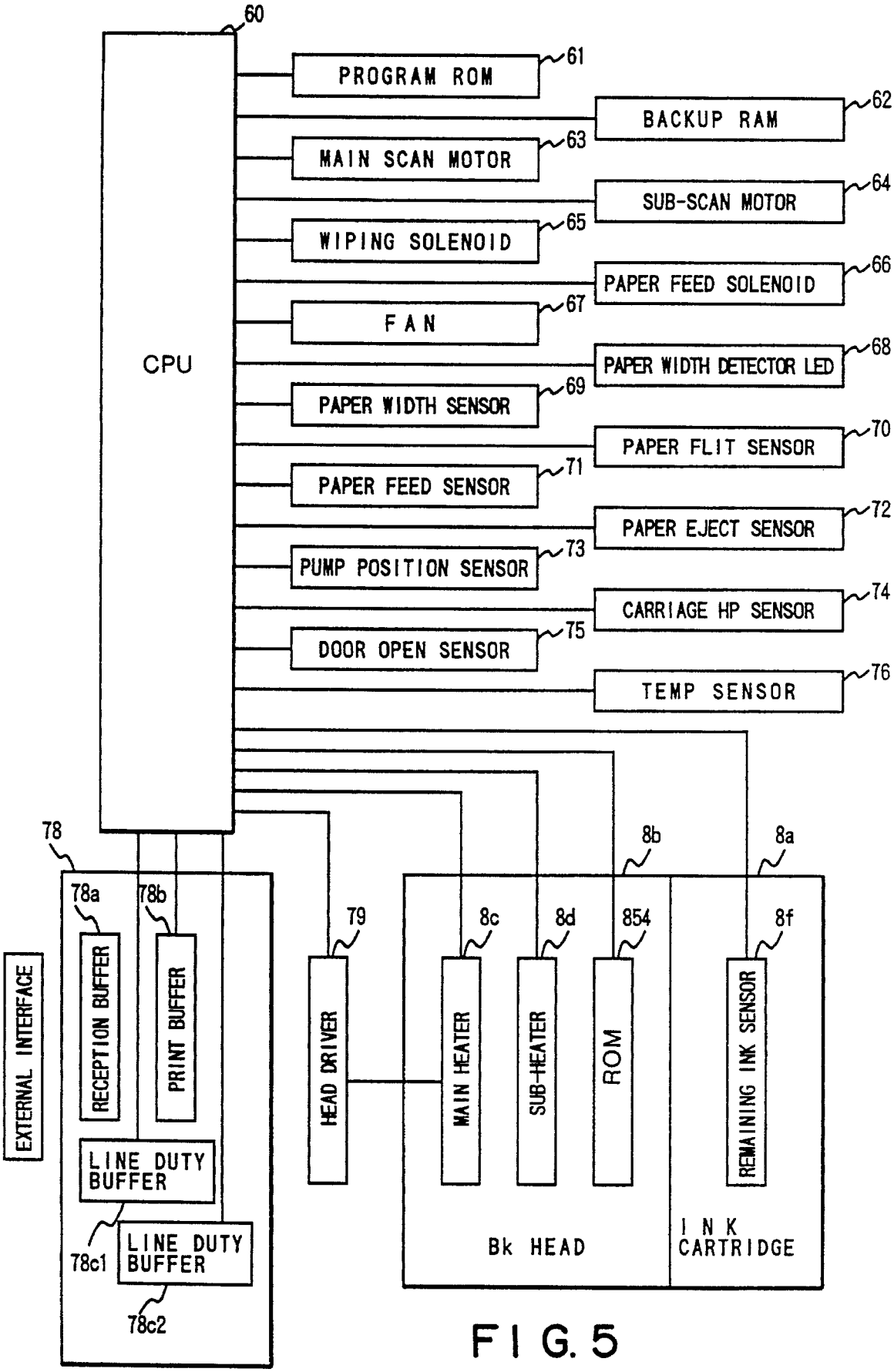
FIG. 5 is a block diagram showing a control arrangement for executing a recording control flow.

A control arrangement for executing recording control of the respective units of the above-mentioned apparatus arrangement will be described below with reference to FIG. 5. As shown in FIG. 5, the recording apparatus includes a CPU 60, a program ROM 61 for storing a control program executed by the CPU 60, an EEPROM 62 for storing various data, the main scan motor 63 for moving the recording heads, and the sub-scan motor 64 for conveying a recording sheet. The sub-scan motor 64 is also used in a suction operation by a pump. The apparatus also includes a wiping solenoid 65, a paper feed solenoid 66 used in paper feed control, a cooling fan 67, a paper width detector LED 68, which is turned on in a paper width detection operation, a paper width sensor 69, a paper flit sensor 70, a paper feed sensor 71, a paper eject sensor 72, a pump position sensor 73 for detecting the position of a suction pump, a carriage HP sensor 74 for detecting the home position of the carriage, a door open sensor 75 for detecting an open/closed state of a door, and a temperature sensor 76 for detecting the surrounding temperature of the apparatus.

Furthermore, the apparatus includes a gate array 78 for performing supply control of recording data to the heads of four colors, a head driver 79 for driving the head, the ink cartridges 8*a* for four colors, and the recording heads 8*b* for four colors. FIG. 5 shows only the cartridge 8*a* and the head 8*b* for black (Bk). The ink cartridge 8*a* has a remaining ink sensor 8*f* for detecting the remaining quantity of an ink. The head 8*b* has a main heater 8*c* for ejecting an ink, a sub-heater 8*d* for performing temperature control of the head, and a ROM 854 for storing various data for the head.

Figure 6:
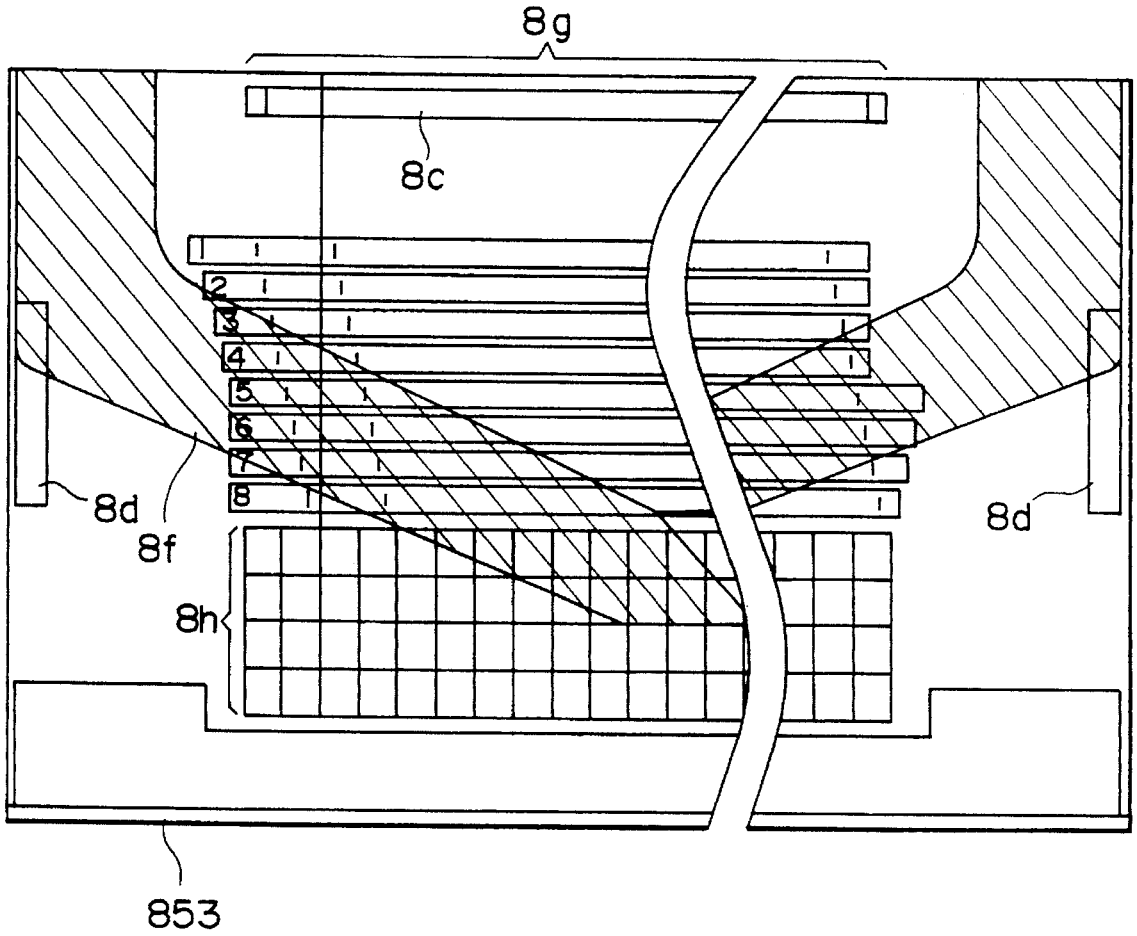
FIG. 6 is a view showing the positional relationship between a sub-heater and an ejection (main) heater of the head used in this embodiment.

FIG. 6 shows a heater board (H.B.) 853 of the head used in this embodiment. An ejection unit array 8*g* in which the temperature control (sub) heaters 8*d* and the ejection (main) heaters 8*c* are arranged, and driving elements 8*h* are formed on a single board to have the positional relationship shown in FIG. 6. Since these elements are arranged on the single board, the head temperature can be efficiently detected and controlled. Thus, the head can be further miniaturized, and the manufacturing processing can be further simplified. FIG. 6 also shows the positional relationship of an outer shielding surface 8*f* of a top plate for separating the H.B. into a region filled with an ink, and a region not filled with an ink.

(First Embodiment)

The first embodiment in which the present invention is applied to the above-mentioned recording apparatus will be described in detail below with reference to the accompanying drawings.

(Summary of Temperature Presumption)

In this embodiment, upon execution of a recording operation by ejecting an ink droplet from a recording head, a surrounding temperature sensor for measuring the surrounding temperature is provided to a main body side to detect a change in head temperature from the past to the present time by calculation processing, so that optimal temperature control can be performed without arranging a head temperature sensor, which has a correlation with the head temperature. Briefly speaking, a change in head temperature is presumed by evaluating it using a matrix which is calculated in advance within a range of a thermal time constant of the head and an applicable energy.

Based on the presumed change in temperature, the head is controlled by a divided pulse width modulation driving method (PWM driving method) for a heater (sub-heater) for increasing the temperature of the head, and an ejection heater. In one driving method of this control, when a difference from a temperature control target value is large, the temperature is increased to a temperature near the target value using the sub-heater, and the remaining temperature difference is controlled by PWM ejection quantity control, so that the ejection quantity can become constant. Thus, upon use of PWM as ejection quantity control means for a short-response time head, no response delay time in temperature detection due to the sensor position like in a case wherein the temperature sensor in the head is used, is generated due to calculation processing, and control which can maximally utilize this merit can be performed.

More specifically, density nonuniformity in one line or in one page can be eliminated. Thus, PWM in one line can be realized without arranging a temperature sensor in a head, as described above.

(PWM Control)

The ejection quantity control method of this embodiment will be described in detail below with reference to the accompanying drawings.

Figure 7:
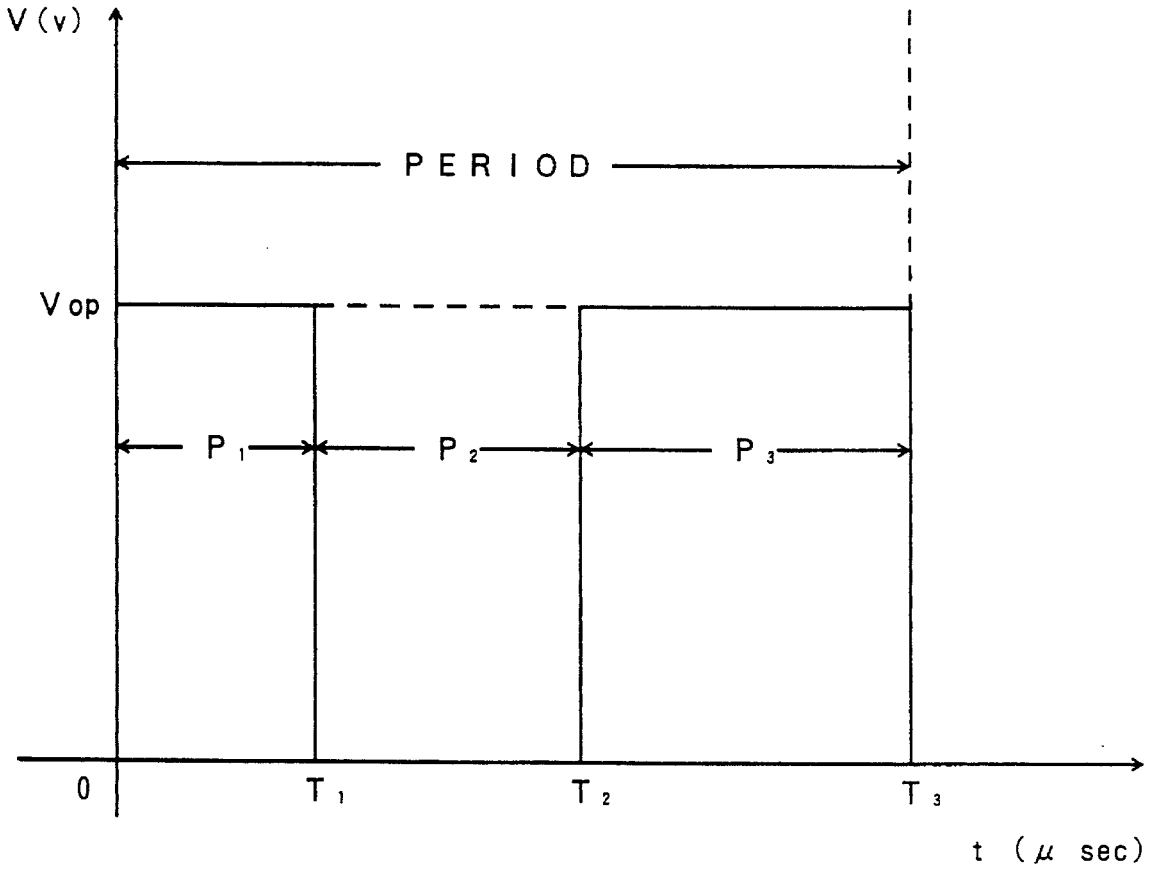
FIG. 7 is an explanatory view of a divided pulse width modulation driving method.

FIG. 7 is a view for explaining divided pulses according to the embodiment of the present invention. In FIG. 7, VOP represents a driving voltage, P1 represents the pulse width of the first pulse (to be referred to as a pre-heat pulse hereinafter) of a plurality of divided heat pulses, P2 represents the interval time, and P3 represents the pulse width of the second pulse (to be referred to as a main heat pulse hereinafter). T1, T2, and T3 represent times for determining P1, P2, and P3. The driving voltage VOP corresponds to a kind of electrical energy necessary for causing an electrothermal converting element applied with this voltage to generate a heat energy in an ink in an ink channel constituted by the heater board and the top plate. The value of the driving voltage VOP is determined by the area, resistance, and film structure of the electrothermal converting element, and the channel structure of the recording head. In the divided pulse width modulation driving method, pulses are sequentially applied to have the widths P1, P2, and P3. The pre-heat pulse is a pulse for mainly controlling the ink temperature in the ink channel, and plays an important role in the ejection quantity control of the present invention. The pre-heat pulse width is set to be a value, which does not cause a bubble forming phenomenon in an ink by a heat energy generated by the electrothermal converting element upon application of the pre-heat pulse.

The interval time is set to form a predetermined time interval, so that the pre-heat pulse and the main heat pulse do not interfere with each other, and to obtain a uniform temperature distribution of an ink in the ink channel. The main heat pulse forms a bubble in an ink in the ink channel to eject the ink from the ejection port. The pulse width P3 of the main heat pulse is determined by the area, resistance, and film structure of the electrothermal converting element, and the ink channel structure of the recording head.

Figure 8A:
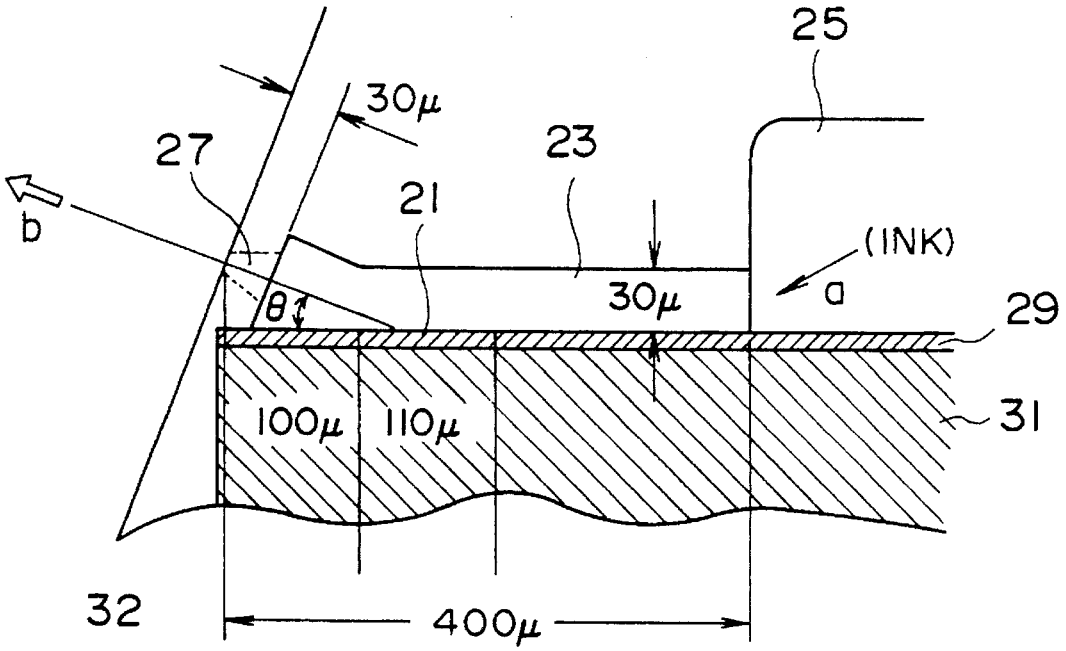
FIGS. 8A and 8B are respectively a schematic longitudinal sectional view and a schematic front view showing an arrangement along an ink channel of a recording head to which the present invention can be applied.
Figure 8B:
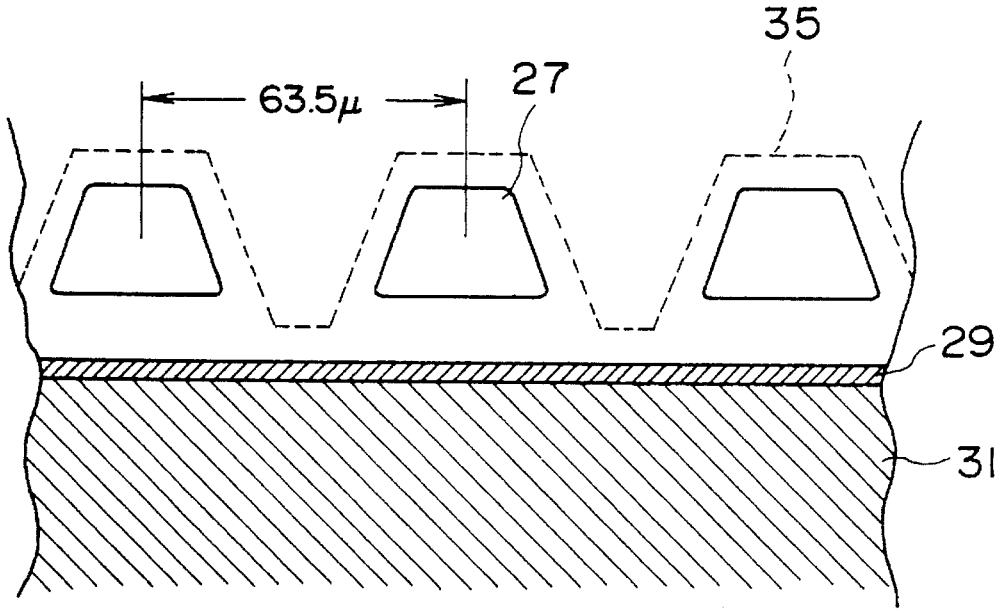

The function of the pre-heat pulse in a recording head having the structure shown in, e.g., FIGS. 8A and 8B will be explained below. FIGS. 8A and 8B are respectively a schematic longitudinal sectional view and a schematic front view showing an arrangement along an ink channel of a recording head to which the present invention can be applied. In FIGS. 8A and 8B, each electrothermal converting element (ejection heater) 21 generates heat upon application of the above-mentioned divided pulses. The electrothermal converting element 21 is arranged on a heater board together with an electrode wiring line, and the like for applying the divided pulses to the converter. The heater board is formed of a silicon layer 29, and is supported by an aluminum plate 31 constituting the board of the recording head. A groove 35 constituting, e.g., an ink channel 23, is formed in a top plate (orifice plate) 32. When the top plate 32 and the heater board (aluminum plate 31) are joined to each other, the ink channel 23, and a common ink chamber 25 for supplying an ink to the channel are defined. Ejection ports 27 (ports having a hole area corresponding to a hole diameter of 20 μ are exemplified in FIG. 8B) are formed in the top plate 32, and communicate with the ink channel 23.

Figure 9:
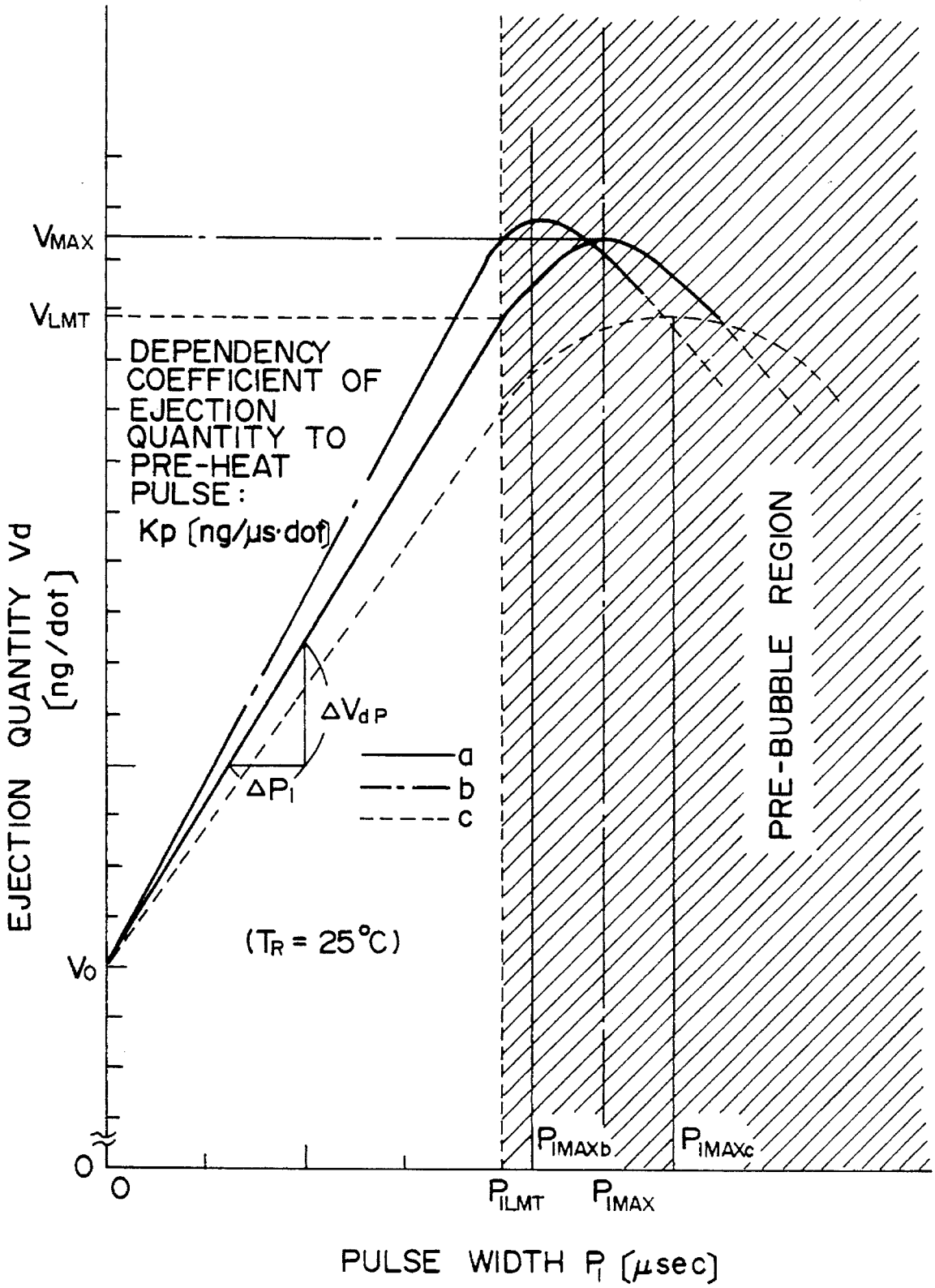
FIG. 9 is a graph showing pre-heat pulse dependency of the ejection quantity.

In the recording head shown in FIGS. 8A and 8B, when the driving voltage VOP=18.0 V and the main heat pulse width P3=4.114 μsec are set, and the pre-heat pulse width P1 is changed within a range of 0 and 3.000 μsec, the relationship between an ejection quantity Vd [ng/dot] and the pre-heat pulse width P1 [μsec], as shown in FIG. 9, is obtained.

FIG. 9 is a graph showing pre-heat pulse dependency of the ejection quantity. In FIG. 9, V0 represents the ejection quantity when P1=0 μsec. This value is determined by the head structure shown in FIGS. 8A and 8B. In this connection, V0 in this embodiment was V0=18.0 ng/dot when a surrounding temperature TR=25° C. As indicated by a curve a in FIG. 9, as the pulse width P1 of the pre-heat pulse is increased, the ejection quantity Vd is increased to have linearity when the pulse width P1 falls within a range between 0 and P1LMT, and its change loses linearity when the pulse width P1 exceeds P1LMT. The ejection quantity Vd is saturated and becomes maximum at a pulse width P1MAX.

In this manner, the range up to the pulse width P1LMT, in which a change in ejection quantity Vd shows linearity with respect to a change in pulse width P1, is effective as a range in which ejection quantity control is easily performed by changing the pulse width P1. In this connection, in this embodiment, P1LMT=1.87 μs, and the ejection quantity at that time was VLMT=24.0 ng/dot. In addition, the pulse width P1MAX corresponding to the saturation state of the ejection quantity Vd was P1MAX=2.1 μs, and the ejection quantity at that time was VMAX=25.5 ng/dot.

When the pulse width is larger than P1MAX, the ejection quantity Vd becomes smaller than VMAX. This phenomenon occurs for the following reason. That is, when the pre-heat pulse having a pulse width within the above-mentioned range is applied, a very small bubble (in a state immediately before film boiling) is formed on the electrothermal converting element, the next main heat pulse is applied before this bubble disappears, and the very small bubble disturbs bubble formation by the main heat pulse, thus decreasing the ejection quantity. This region will be referred to as a pre-bubble region hereinafter, and it is difficult to perform ejection quantity control using the pre-heat pulse in this region.

If the inclination of a straight line representing the relationship between the ejection quantity and the pulse width within the range of P1 (0 to P1LMT [μs]) shown in FIG. 9 is defined as a dependency coefficient of the pre-heat pulse, the dependency coefficient of the pre-heat pulse is given by:

$$KP = \frac{\Delta VdP}{\Delta P1} \text{ [ng/μsec · dot]}$$

This coefficient KP is determined by the head structure, driving conditions, ink physical characteristics, and the like independently of the temperature. More specifically, curves b and c in FIG. 9 represent other recording heads. As can be seen from these curves, different recording heads have different ejection characteristics. In this manner, since the different recording heads have different upper limit values P1LMT of the pre-heat pulse P1, ejection quantity control is performed by determining the upper limit value P1LMT for each recording head, as will be described later. Note that KP=3.209 ng/μsec·dot in a recording head and an ink represented by the curve a of this embodiment.

Another factor for determining the ejection quantity of the ink-jet recording head is the temperature of the recording head (ink temperature).

Figure 10:
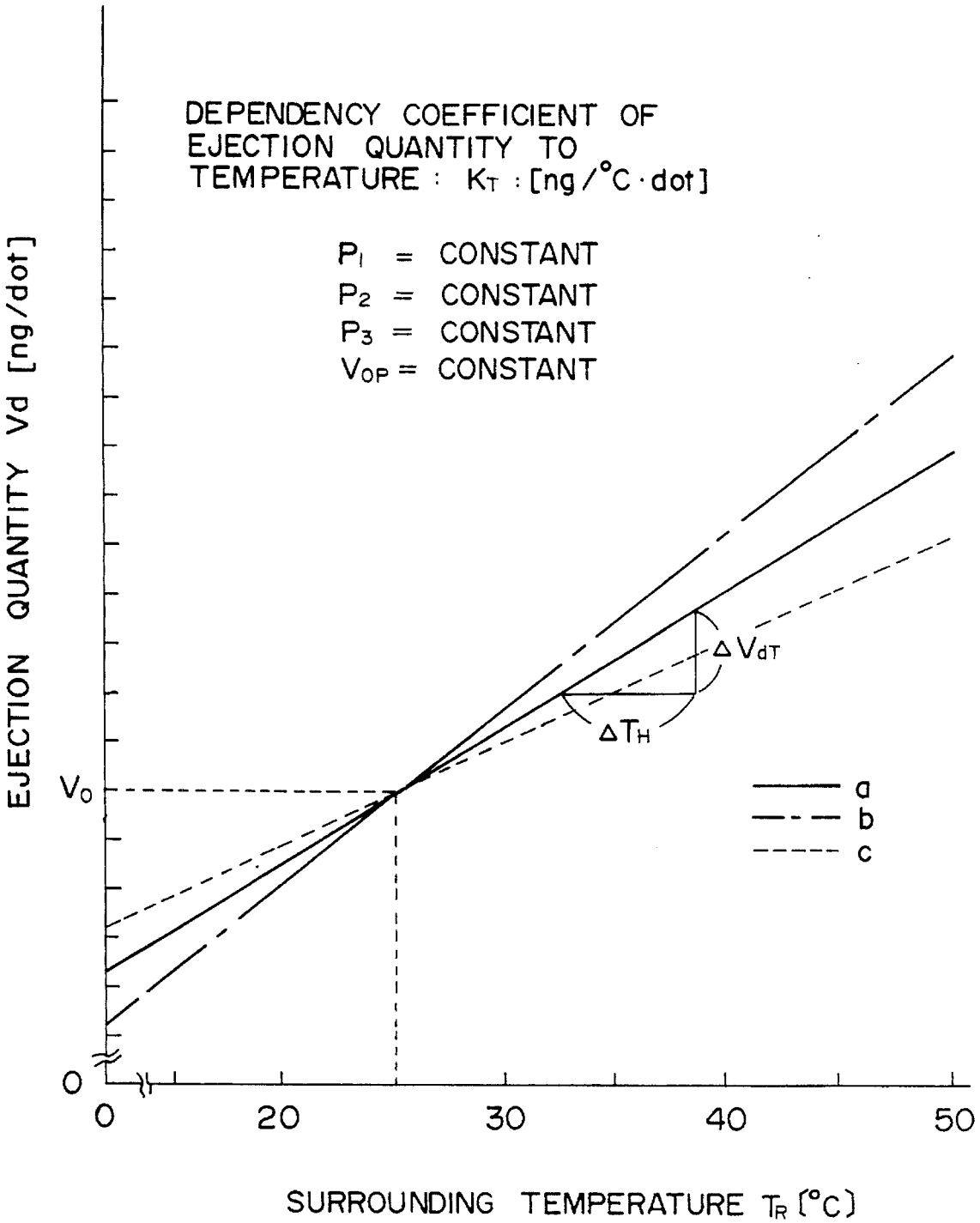
FIG. 10 is a graph showing temperature dependency of the ejection quantity.

FIG. 10 is a graph showing temperature dependency of the ejection quantity. As indicated by a curve a in FIG. 10, the ejection quantity Vd linearly increases with respect to an increase in surrounding temperature TR (=head temperature TH) of the recording head. If the inclination of this straight line is defined as a temperature dependency coefficient, the temperature dependency coefficient is given by:

$$KT = \frac{\Delta VdT}{\Delta TH} \text{ [ng/°C. · dot]}$$

This coefficient KT is determined by the head structure, ink physical characteristics, and the like independently of driving conditions. FIG. 10 also shows curves b and c representing other recording heads. Note that KT=0.3 ng/° C.·dot in the recording head of this embodiment.

As described above, ejection quantity control according to the present invention can be performed using the relationships shown in FIGS. 9 and 10.

(Temperature Presumption Control)

An operation when a recording operation is performed using the recording apparatus with the above arrangement will be described below with reference to the flow charts shown in FIGS. 11 to 13.

If a power supply is turned on in step S100, a temperature correction timer is reset and set (S110). Then, the temperature of a temperature sensor (to be referred to as a reference thermistor hereinafter) on a main body printed circuit board (to be referred to as a PCB hereinafter) is read (S120), thereby detecting the surrounding temperature. However, since the reference thermistor is present on the PCB, it cannot often detect an accurate surrounding temperature of the head under the influence of a heat generating member (e.g., a driver) on the PCB. Thus, the detection value is corrected according to a time elapsed from the ON operation of the main body power supply so as to obtain a surrounding temperature. More specifically, a time elapsed from the ON operation of the power supply is read from the temperature correction timer (S130) to refer to a temperature correction table (Table 1), thus obtaining an accurate surrounding temperature from which the influence of the heat generating member is eliminated (S140).

TABLE 1

| Temperature Correction Timer (min) | 0 to 2 | 2 to 5 | 5 to 15 | 15 to 30 | Over 30 |
|---|---|---|---|---|---|
| Correction Value (°C.) | 0 | −2 | −4 | −6 | −7 |

In step S150, a current head chip temperature (β) is presumed with reference to a temperature presumption table (FIG. 14), and the control waits for input of a print signal. The presumption of the current head chip temperature (β) is performed by adding, to the surrounding temperature obtained in step S140, a value determined by a matrix of temperature differences between the head temperature and the surrounding temperature with respect to the applied energy (power ratio) to the head, thereby updating the surrounding temperature. Immediately after a power-ON operation, since no print signal is input (applied energy=0), and the temperature difference between the head temperature and the surrounding temperature is also 0, a matrix value 0 (thermal equilibrium) is added. If no print signal is input, the flow returns to step S120, and processing is repeated from a reading operation of the temperature of the reference thermistor. In this embodiment, the presumption cycle of the head chip temperature was set to be 0.1 sec.

The temperature presumption table shown in FIG. 14 is a matrix table showing temperature rise characteristics per unit time, which are determined by the thermal time constant of the head, and the energy applied to the head. When the power ratio is large, the matrix value becomes large, while when the temperature difference between the head temperature and the surrounding temperature becomes large, since a thermal equilibrium state can be easily established, the matrix value is decreased. The thermal equilibrium state is established when the applied energy is equal to the radiation energy. In the table shown in FIG. 14, "power ratio=500%" means that the applied energy obtained upon energization of the sub-heater is converted into a power ratio.

When the matrix value is accumulated per unit time on the basis of this table, the temperature of the head at that time can be presumed.

When a print signal is input, a print target temperature (α) of the head chip, which allows an optimal driving operation at the current surrounding temperature, is obtained with reference to a target (driving) temperature table (Table 2) (S170). In Table 2 below, the reason why the target temperature varies depending on the surrounding temperature is that even when the temperature on the silicon heater board of the head is controlled to a given temperature, since the temperature of an ink flowing into the head is low, and the thermal time constant is large, the temperature of a system around the head chip becomes consequently low if this temperature is considered as an average temperature. For this reason, as the surrounding temperature becomes lower, the target temperature of the silicon heater board of the head must be increased.

TABLE 2

| Surrounding Temperature (°C.) | Target Temperature α (°C.) |
|---|---|
| Below 12 | 35 |
| 12 to 15 | 33 |
| 15 to 16 | 31 |
| 16 to 17 | 29 |
| 17 to 19 | 27 |
| 19 to 21 | 25 |
| Over 21 | 23 |

In step S180, a difference γ (=α−β) between the print target temperature (α) and the current head chip temperature (β) is calculated. In step S190, an ON time (t) of the sub-heater before the print operation for the purpose of decreasing the difference (γ) is obtained with reference to a sub-heater control table (Table 3), and the sub-heater is turned on (S300). This is a function of increasing the temperature of the entire head chip by the sub-heater when the presumed temperature of the head and the target temperature have a difference therebetween at the beginning of the print operation. Thus, the temperature of the entire head chip can be set to be close to the target temperature as much as possible.

TABLE 3

| Difference γ(°C.) | Sub-heater ON Time (sec) |
|---|---|
| Below −15 | 6 |
| −15 to −12 | 5 |
| −12 to −9 | 4 |
| −9 to −6 | 3 |

TABLE 3-continued

| Difference γ(°C.) | Sub-heater ON Time (sec) |
|---|---|
| −6 to −5 | 2 |
| −5 to −4 | 1 |
| −4 to −3 | 0.5 |
| −3 to −2 | 0.2 |
| over −2 | 0 |

After the sub-heater is turned on for the above setting time, the sub-heater is turned off, and the current chip temperature (β) is presumed with reference to the current temperature presumption table (FIG. 14). Then, a difference (γ) between the print target temperature (α) and tile head chip temperature (β) is calculated (S320), and a PWM value at the beginning of the print operation is obtained from a PWM value determination table (Table 4) according to the difference (γ) (S330). It is difficult to cause the chip temperature to precisely approach the target temperature even using the sub-heater, and furthermore, it is very difficult to perform temperature correction in one line by the sub-heater. Thus, in this embodiment, the ejection quantity is corrected by the PWM method in accordance with the remaining difference from the target value. In particular, in this embodiment, the above-mentioned value P1 is increased to increase the ejection quantity.

TABLE 4

| | Difference (°C.) | P1 |
|---|---|---|
| (1) | Below −10 | 1.87 |
| (2) | −10 to −9 | 1.683 |
| (3) | −9 to −8 | 1.496 |
| (4) | −8 to −7 | 1.309 |
| (5) | −7 to −6 | 1.122 |
| (6) | −6 to −5 | 0.935 |
| (7) | −5 to −4 | 0.748 |
| (8) | −4 to −3 | 0.561 |
| (9) | −3 to −2 | 0.374 |
| (10) | −2 to −1 | 0.187 |
| (11) | Over −1 | 0 |

In this embodiment, the PWM value is optimized every time a predetermined area is printed in a one-line print operation. In this case, one line is divided into 10 areas, and an optimal PWM value is set for each area. More specifically, this operation is performed as follows.

A variable n is reset (n=0), and n is incremented (n=n+1) (S340, S350). Note that n represents each area. The print operation of an n-th area is performed (S360), and upon completion of the print operation of the 10th area, the flow returns to step S130 to read the temperature of the reference thermistor. If n<10, and areas to be printed remain in one line (S370), the flow advances to step S380 to obtain a change in temperature of the head caused by the print operation of the immediately preceding area. More specifically, a head chip temperature (β) upon completion of the print operation of the n-th area (immediately before the print operation of an (n+1)-th area) is obtained with reference to the current temperature presumption table (FIG. 14) (S380). A difference (γ) between the print target temperature (α) and the head chip temperature (β) is calculated, and a PWM value upon printing of the (n+1)-th area is set with reference to the PWM value determination table (Table 4) according to the difference (γ) (S390, S400, S410). Thereafter, the flow returns to step S350. Thus, n is incremented (n=n+1), and the above-mentioned control is repeated until n=10.

Under the above-mentioned control, the head chip temperature (β) can gradually approach the print target temperature (α). Even if a large temperature difference is present between the head chip temperature (β) and the print target temperature (α) like in an early period after power-ON, since PWM control is performed within one line, an actual ejection quantity can be controlled like that at the print target temperature, and high quality can be realized. The reason why this embodiment does not simply use the number of dots (print duty) is that an energy to be supplied to a head chip varies depending on different PWM values even if the number of dots remains the same. Since the concept of "power ratio" is used, the same table can be used even when the sub-heater is turned The ejection quantity control will be described again. Stabilization control of the ejection operation/ejection quantity of the head is attained by controlling the following two points.

① A target temperature (ejection stable head temperature) at which ejection is most stabilized is obtained, and control is made so that the head temperature reaches the obtained temperature. The target temperature is obtained from a "target temperature table". The target temperature (ejection stable head temperature) depends on the surrounding temperature. At this time, head temperature control within a wide range is performed using the sub-heater (having a large heat generation amount). Head temperature control within a narrow range is attained by self temperature rise/self heat radiation of the head. Note that PWM control, which expects a temperature fall, may be performed.

② An ejection quantity obtained when an ink is normally ejected at the target temperature is determined as a target ejection quantity, and even when the head temperature is shifted from the target temperature, control is made so that the ejection quantity becomes equal to the target ejection quantity. A shift (difference) between the target temperature and the actual head temperature is presumed. At this time, an ejection applied energy, which can compensate for the difference, is applied by the PWM control.

A recording signal sent through an external interface is stored in a reception buffer 78*a* of the gate array 78. The data stored in the reception buffer 78*a* is expanded to a binary signal (0, 1) indicating "ejection/no ejection", and the binary signal is transferred to a print buffer 78*b*. The CPU 60 can refer to the recording signal from the print buffer 78*b* as needed.

In the gate array 78, two line duty buffers 78*c* are prepared. One line upon recording is divided at equal intervals (into, e.g., 10 areas), and the print duty (ratio) of each area is calculated and stored in the duty buffers. The "line duty buffer 78*c*1" stores print duty data in units of areas of the currently printing line. The "line duty buffer 78*c*2" stores print duty data in units of areas of a line next to the currently printing line. The CPU 60 can refer to the print duty data in units of areas of the currently printing line and the next line any time, as needed.

The CPU 60 refers to the line duty buffers 78*c* during the above-mentioned temperature prediction control to obtain the print duties of the areas. Therefore, a calculation load on the CPU 60 can be reduced.

Figure 15A:
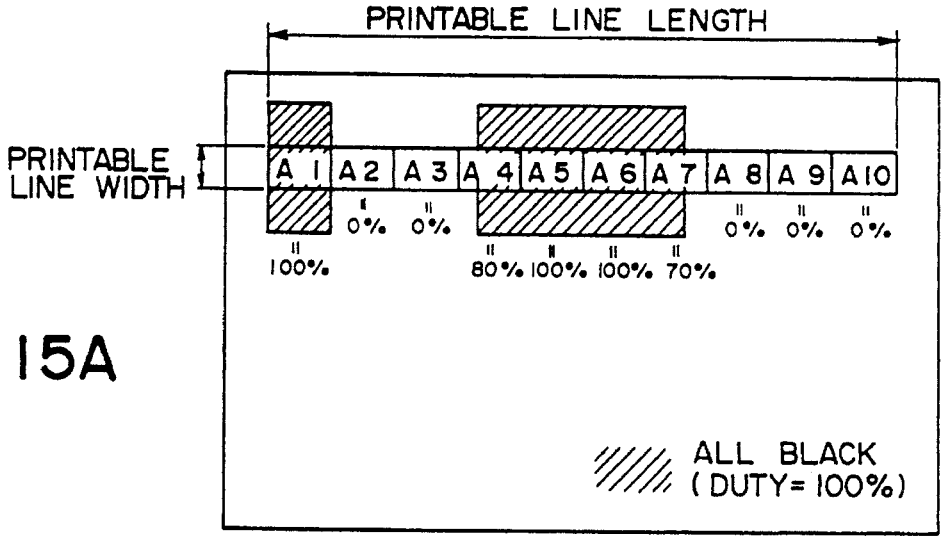
FIGS. 15A–15E and 16A–16E are explanatory views associated with temperature presumption·prediction control.
Figure 15B:
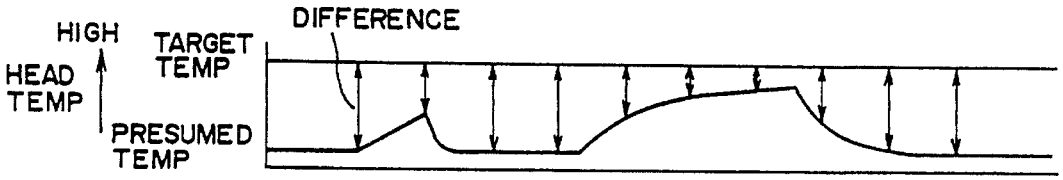
Figure 15C:
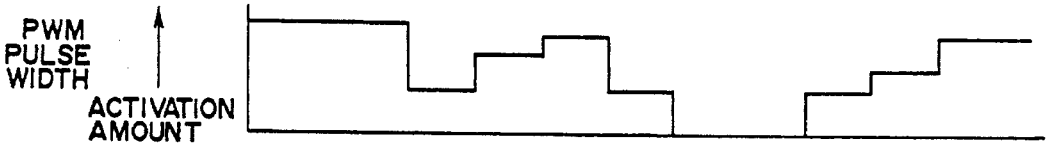
Figure 15D:
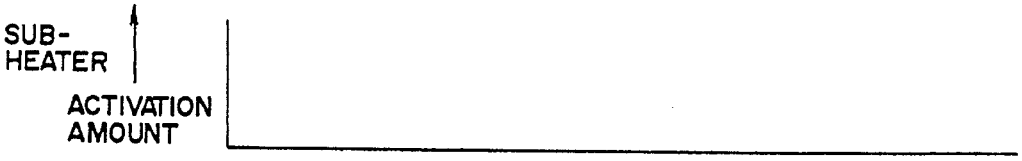
Figure 15E:
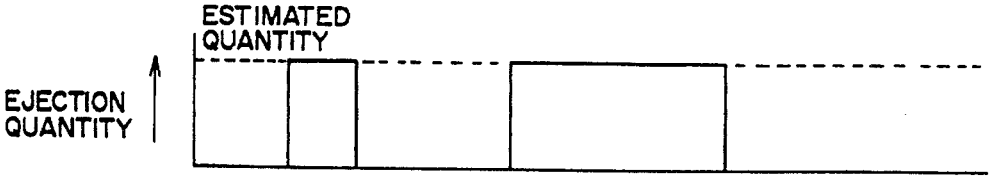

The temperature prediction control will be explained in detail below with reference to the explanatory views shogun in FIGS. 15A to 16E. First, a difference between the surrounding temperature and the head temperature is calculated to check if the heating operation of the sub-heater immediately before printing is necessary. In FIG. 15B, since the head temperature is not largely shifted from the target temperature, the heating operation of the sub-heater is not performed (FIG. 15D). The head temperature (FIG. 15B) immediately before printing of an area A1 is presumed, and the print operation is performed using a PWM value (FIG. 15C) for the area A1 according to the difference. In this case, since it can be determined based on the PWM value of the area A1 that the area A1 is printed with a duty of 100%, the temperature immediately before printing of the next area A2 is presumed.

Since the duty of the area A1 is high, it can be presumed that the temperature immediately before printing of the area A2 is high, and a low PWM value is set. Since the area A2 has a low duty (0%) and low PWM value, it can be presumed that the temperature immediately before printing of an area A3 is decreased. Therefore, a large PWM value immediately before printing of an area A4 is set to perform the print operation.

In areas A4, A5, A6, and A7, since actual print duties are high, it can be presumed that the head temperature is gradually increased, and the print operations are performed while gradually decreasing the PWM values. After an area A8, since actual print duties are low, it can be presumed that the head temperature is gradually decreased, and the print operations are performed while gradually increasing the PWM values (since the print duty is 0, no actual print operation is performed). As described above, the print operation is performed while the PWM value upon printing of each area is set based on the presence/absence of use and power of the sub-heater before printing, and the head temperature presumed value immediately before printing of each area. Since it is expected that the head temperature (FIG. 15B) is not largely shifted from the reference temperature in the one-line print operation, the sub-heater is not turned on immediately before printing of the next line.

Figure 16A:
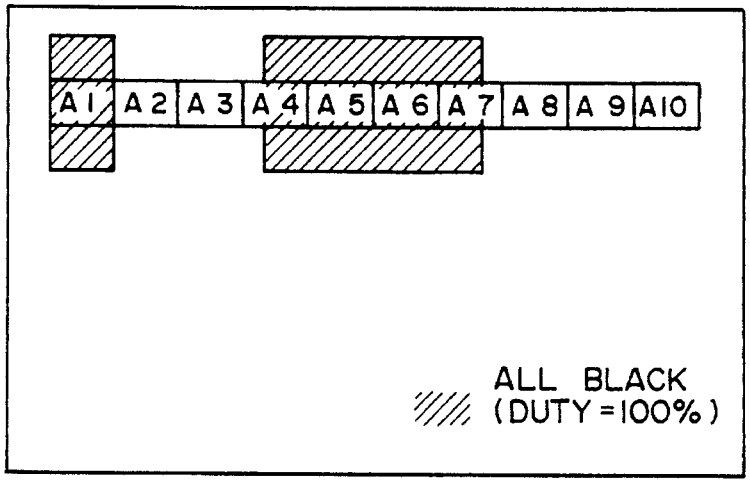
Figure 16B:
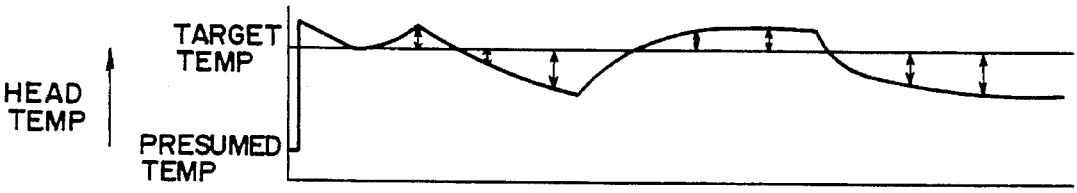
Figure 16C:
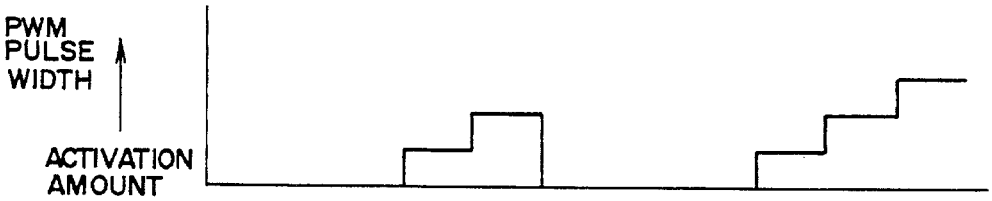
Figure 16D:
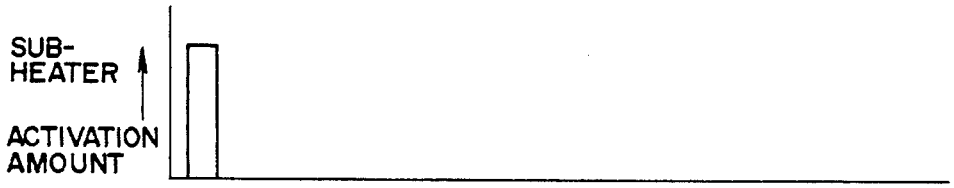
Figure 16E:
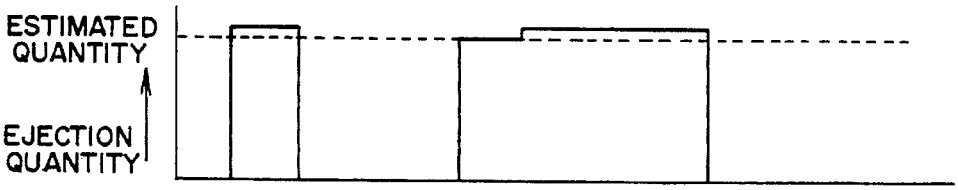

In FIGS. 16A to 16E, a difference between the surrounding temperature and the head temperature is calculated to check if the heating operation of the sub-heater immediately before printing is necessary. In this case, since the head temperature is largely shifted from the target temperature, it is determined that the heating operation of the sub-heater is necessary, and the heating operation of the sub-heater is performed (FIG. 16D). Then, a head temperature upon completion of the heating operation of the sub-heater and immediately before printing of an area A1 (FIG. 16B) is presumed. Since it is presumed that the head temperature exceeds the target temperature, a minimum value is assigned to the PWM value (FIG. 16C) upon printing of the area A1. Although the heating operation of the sub-heater can increase the temperature in an early period of the heating operation, since the difference between the head temperature and the target temperature is large, it can be easily presumed that the head temperature is decreased below the reference temperature upon completion of printing. Therefore, the head temperature immediately after the sub-heater is turned on is intentionally set to exceed the target temperature.

The minimum value is assigned to the PWM value of the area A1 to perform the print operation. However, since the duty (100%) of the area A1 is high, it is presumed that the temperature immediately before printing of an area A2 is not decreased below the target temperature, and a minimum PWM value is set for the area A2. In areas A2 and A3, since actual print duties are small, the head temperature is gradually decreased to a temperature below the target temperature, and optimal PWM values are set to perform the print operations (in this case, since the print duties are 0, no actual print operations are performed). Thereafter, the heating operation of the sub-heater and the actual print operations are performed, while setting the PWM values of the areas in the same manner as in FIGS. 15A to 15E.

A difference between the cases in FIGS. 15A to 15E and FIGS. 16A to 16E is that the ejection quantity does not exceed the ejection quantity (FIG. 15E) at the target temperature in the former case, while the ejection quantity sometimes exceeds the ejection quantity (FIG. 16E) at the target temperature in the latter case. This is because no negative PWM value for decreasing the ejection quantity is set in this embodiment. In a practical application, a negative PWM value may be provided.

In this embodiment, double-pulse PWM control is used to control the ejection quantity. However, single-pulse PWM or PWM using triple pulses or more may be used.

When the head chip temperature (β) is higher than the print target temperature (α), and the head chip temperature cannot be decreased even when the head is driven with a small energy PWM value, the scanning speed of the carriage may be controlled, or the scanning start timing of the carriage may be controlled.

The number of divided areas (10 areas) in one line, and constants such as the temperature prediction cycle (0.1 sec), and the like used in this embodiment area merely examples, and the present invention is not limited to these.

(Second Embodiment)

Figure 21:
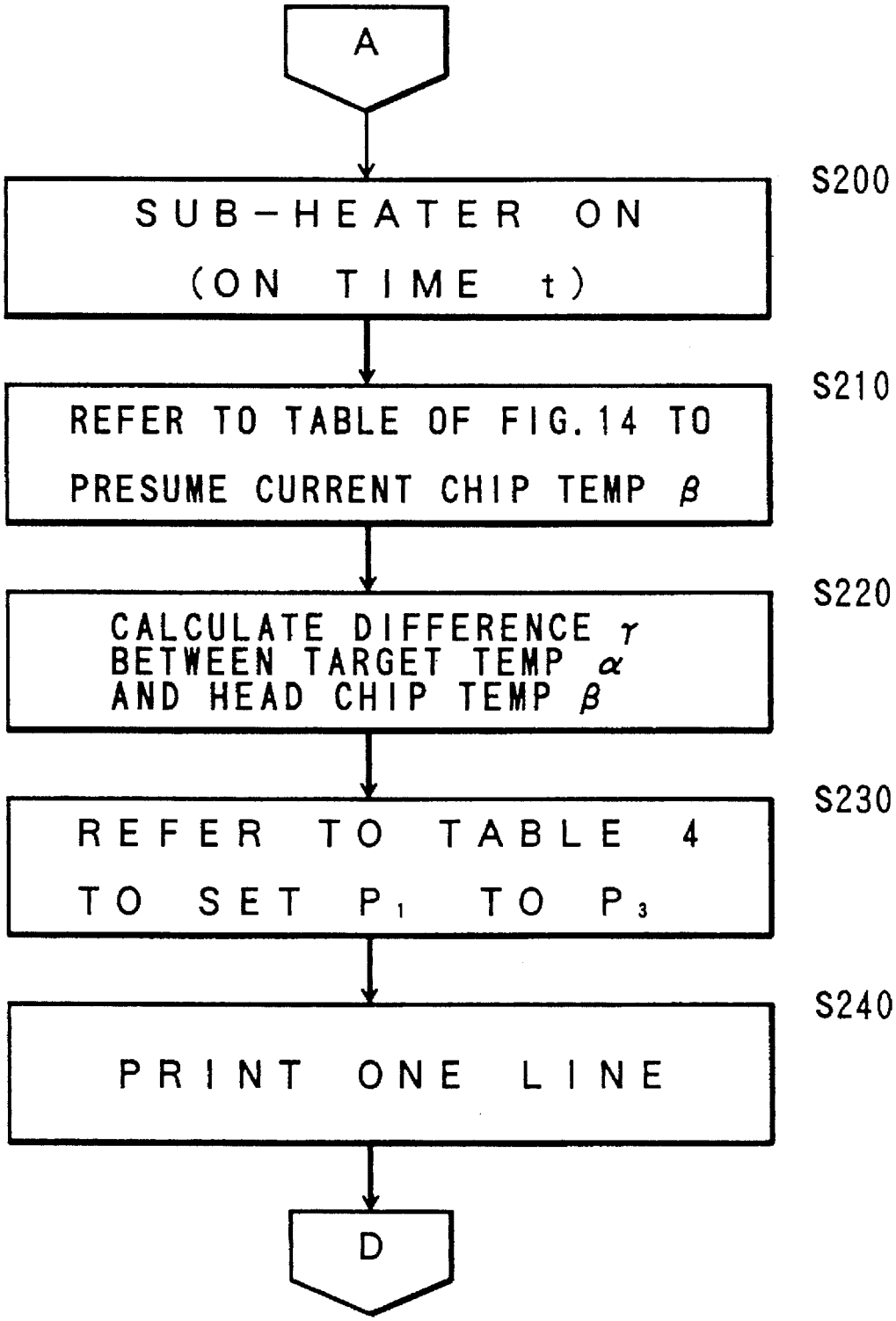
FIGS. 21 to 23 are flow charts associated with temperature prediction control.

Another embodiment for further stabilizing the ejection quantity will be described below with reference to FIG. 21. In the first embodiment, every time a predetermined area is printed in a one-line print operation, a PWM value is optimized. For this reason, even when a large change in print duty occurs in one line, density nonuniformity does not often occur in one line. However, since the PWM values are optimized during printing, the load on a CPU is undesirably increased. Thus, in the second embodiment, control for performing a one-line print operation using a PWM value at the beginning of the print operation is made to reduce the load on the CPU.

Since the same control as in the first embodiment is performed up to step S190 (FIG. 11), a description thereof will be omitted.

In step S190, an ON time (t) of a sub-heater before printing for the purpose of decreasing the difference (γ) is obtained with reference to a sub-heater control table (Table 3). Thereafter, the sub-heater is turned on, as shown in FIG. 21 (S200). After the sub-heater is turned on for the setting time, the sub-heater is turned off, a current chip temperature (β) (chip temperature immediately before printing) is presumed with reference to a current temperature presumption table (FIG. 14) (S210).

A difference (γ) between a print target temperature (α) and the current head chip temperature (β) is calculated, and a PWM value is obtained with reference to a PWM value determination table (Table 4) (S220, S230). A one-line print operation is performed according to the obtained PWM value (S240), and after the print operation, the flow returns to step S120 to read the temperature of a reference thermistor.

Under the above-mentioned control, the head chip temperature (β) gradually approaches the print target temperature (α). Even if a large temperature difference is present between the head chip temperature (β) and the print target temperature (α) like in an early period after power-ON, since PWM control is performed in units of lines, an actual ejection quantity can be controlled to approach that at the print target temperature, and high quality can be realized.

In this embodiment, double-pulse PWM control is used to control the ejection quantity. However, single-pulse PWM or PWM using triple pulses or more may be used. When the head chip temperature (β) is higher than the print target temperature (α), and the head chip temperature cannot be decreased even when the head is driven with a small energy PWM value, the scanning speed of the carriage may be controlled, or the scanning start timing of the carriage may be controlled.

(Third Embodiment)

In an ink-jet recording apparatus, a method of presuming the current temperature based on the print ratio (to be referred to as a print duty hereinafter), and controlling a restoration sequence for stabilizing ejection will be explained below. When the above-mentioned PWM control is not performed, the print duty is equal to a power ratio.

Figure 17:
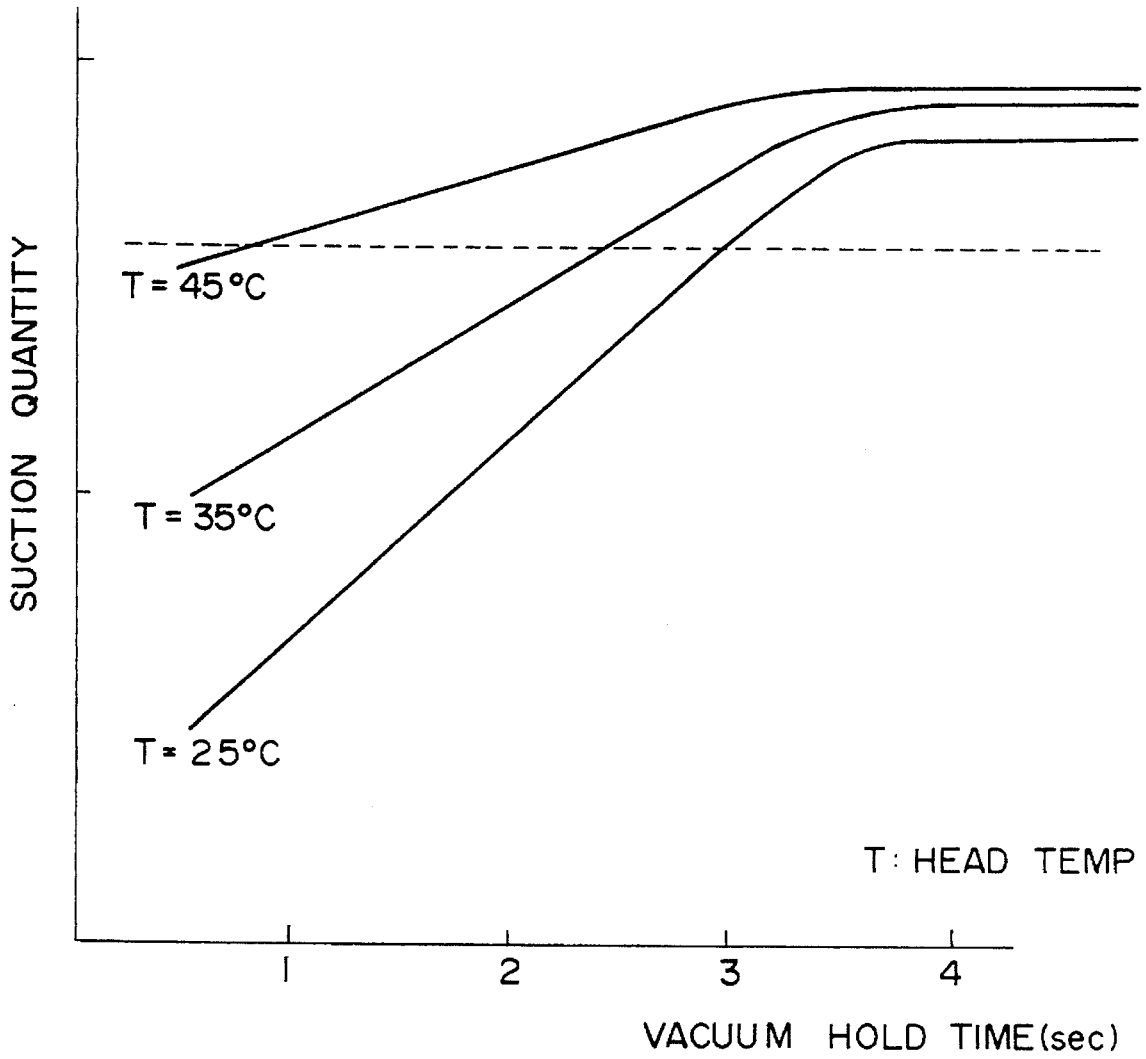
FIG. 17 is a graph showing temperature dependency of the vacuum hold time and the suction quantity.

In this embodiment, the current head temperature is presumed from the print duty like in the first embodiment, and a suction condition of a suction means is changed according to the presumed temperature of the head. The control of the suction condition is made based on the suction pressure (initial piston position) and the suction quantity (a change in volume or a vacuum hold time). FIG. 17 shows head temperature dependency of the vacuum hold time and the suction quantity. Although the suction quantity can be controlled by the vacuum hold time during a given period, the suction quantity does not depend on the vacuum hold time outside the given period. Since the suction quantity is influenced by the head temperature presumed from the print duty, the vacuum hold time is changed according to the head presumed temperature. In this manner, even when the head temperature changes, the ejection quantity can be maintained to be constant (an optimal quantity), thus stabilizing ejection.

When a plurality of heads are used, heat radiation correction is made according to the arrangement of the heads so as to more accurately presume the head temperature. At the end portion of a carriage, heat radiation easily occurs as compared to its central portion, and the temperature distribution varies. For this reason, ejection largely influenced by the temperature also varies. Thus, correction is made while assuming heat radiation at the end portion=100%, and that at the central portion=95%. With this correction, a thermal variation can be prevented, and stable ejection can be attained. Furthermore, the suction condition may be changed in units of heads according to the features or states of the heads.

Furthermore, in this embodiment, a decrease in head temperature upon a suction operation is presumed. When the surrounding temperature and the head temperature have a difference therebetween, an ink at a high temperature is discharged by suction, and a new low-temperature ink is supplied from an ink tank. The high-temperature head is cooled by the supplied ink. Table 5 below shows differences between the surrounding temperature and the head presumed temperature, and temperature fall correction values upon suction. When the head temperature is presumed from the print duty, a temperature fall upon suction can be corrected based on a difference from the surrounding temperature, and a head temperature after suction can be simultaneously predicted.

TABLE 5

| Difference Between Surrounding Temperature and Head Presumed Temperature (°C.) | ΔT in Suction (°C.) |
|---|---|
| 0 to 10 | −1.2 |
| 10 to 20 | −3.6 |
| 20 to 30 | −6.0 |

In the case of an exchangeable head, the temperature of an ink tank must be presumed. Since the ink tank is in contact with the head, a temperature rise caused by ejection influences the ink tank. Thus, an ink tank temperature is presumed from an average of temperatures for the last 10 minutes. In this manner, the ink tank temperature can be fed back to a temperature fall after a suction operation.

In the case of a permanent head, since the head and the ink tank are separated from each other, the temperature of a supplied ink is equal to the surrounding temperature, and the temperature of the ink tank need not be predicted.

Figure 18:
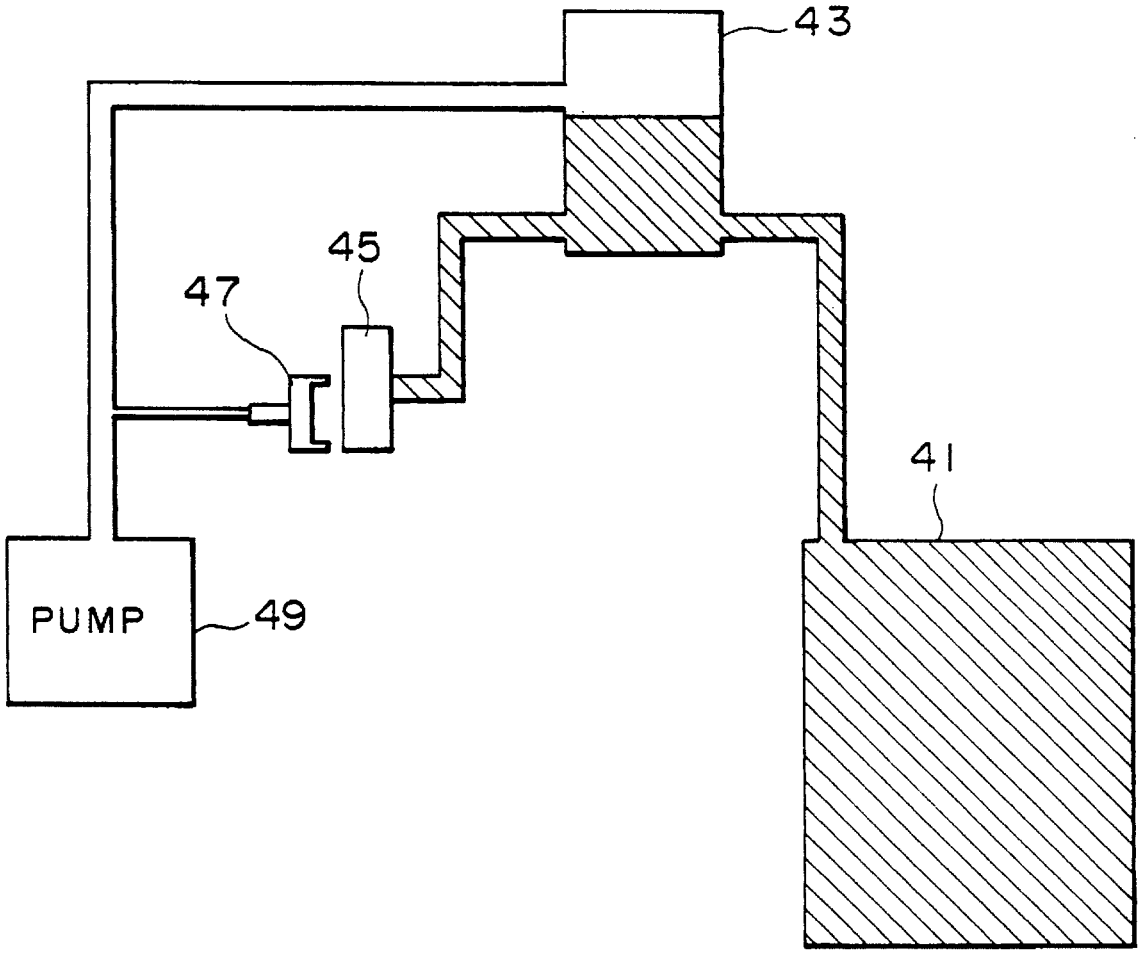
FIG. 18 is a diagram showing a sub-tank system.

Furthermore, in a sub-tank system shown in FIG. 18, since the suction quantity is increased when a suction operation is performed in a high-temperature state of an ink, an ink-level pull-up effect cannot be expected, and this may cause an ink supply error. Thus, when the head temperature predicted from the print duty is high, the number of times of suction operations is increased to obtain a sufficient ink-level pull-up effect. Table 6 below shows the relationship between the difference between the surrounding temperature and the head presumed temperature, and the number of times of suction operations. As the difference between the surrounding temperature and the head presumed temperature is larger, the number of times of suction operations is increased. Thus, the ink-level pull-up effect can be prevented from being impaired. In FIG. 18, a main tank 41 is arranged in an apparatus main body. A sub-tank 43 is mounted on, e.g., a carriage. A head chip 45 is covered by a cap 47. A pump 49 applies a suction force to the cap 47.

TABLE 6

| Difference Between Surrounding Temperature and Head Presumed Temperature (°C.) | Number of Times of Suction |
|---|---|
| 0 to 10 | 8 |
| 10 to 20 | 10 |
| 20 to 30 | 12 |

(Fourth Embodiment)

Like in the third embodiment, the current head temperature is presumed from the print duty. In this embodiment, a pre-ejection condition is changed according to the head presumed temperature.

When the head temperature is high, the ejection quantity is increased,, and wasteful pre-ejection may be performed. In this case, control can be made to decrease the pre-ejection pulse width. Table 7 below shows the relationship between the head presumed temperature and the pulse width. Since the ejection quantity is increased as the temperature is higher, the ejection quantity is controlled by decreasing the pulse width.

TABLE 7

| Head Presumed Temperature (°C.) | Pulse Width (μsec) |
|---|---|
| 20 to 30 | 7.0 |
| 30 to 40 | 6.5 |
| 40 to 50 | 6.0 |
| Over 50 | 5.5 |

Since a temperature variation among nozzles is enlarged as the temperature is higher, the distribution of the number of times of pre-ejection must be optimized. Table 8 below shows the relationship between the head presumed temperature, and the number of pulses in pre-ejection. Even at a normal temperature, the number of times of pre-ejection of nozzles at the end portion is set to be different from that of those at the central portion, thus suppressing the influence due to a temperature variation. As the head temperature becomes higher, since a temperature difference between the end portion and the central portion becomes larger, the difference in the number of times of pre-ejection is also increased. Thus, a variation in temperature distribution among nozzles can be suppressed, and efficient (least minimum) pre-ejection can be performed, thus allowing stable ejection.

TABLE 8

| Head Presumed Temperature (°C.) | 1st to 16th Nozzles | 17th to 48th Nozzles | 49 to 64th Nozzles |
|---|---|---|---|
| 20 to 30 | 10 | 8 | 10 |
| 30 to 40 | 10 | 7 | 10 |
| 40 to 50 | 10 | 6 | 10 |
| Over 50 | 10 | 5 | 10 |

When a plurality of heads are used, different pre-ejection temperature tables may be used in units of ink colors. Table 9 below shows an example of a temperature table. When the head temperature is high, Bk (black) including a larger amount of a dye than Y (yellow), M (magenta), and C (cyan) tends to increase its viscosity. For this reason, the number of times of pre-ejection for Bk must be set to be larger than that for Y, M, and C. In addition, since the ejection quantity is increased as the temperature is higher, the number of times of pre-ejection is suppressed.

TABLE 9

| Head Presumed Temperature (°C.) | Y, M, C | Bk |
|---|---|---|
| 20 to 30 | 16 | 24 |
| 30 to 40 | 14 | 21 |
| 40 to 50 | 12 | 18 |
| Over 50 | 10 | 15 |

Figure 19B:
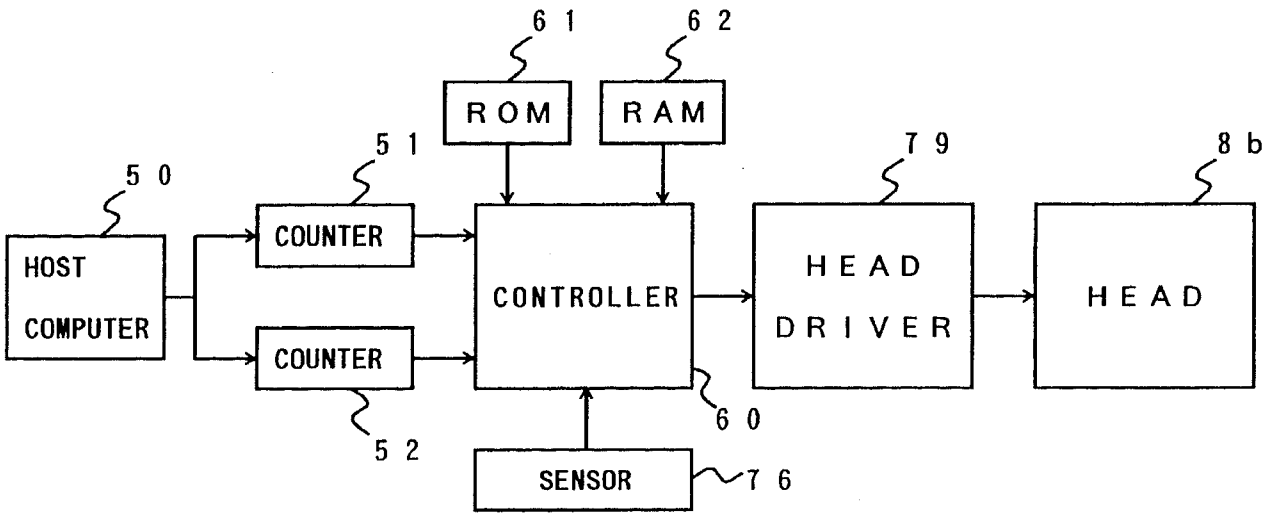
FIGS. 19A and 19B are explanatory views showing another arrangement for presuming the head temperature.
Figure 19A:
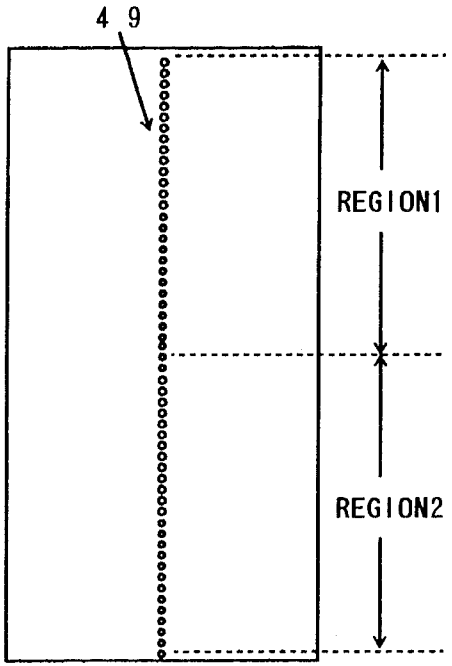

When the number of nozzles is large, a method of presuming the head temperature while dividing nozzles 49 into two regions, as shown in FIG. 19A showing the head surface, is also available. As shown in the block diagram of FIG. 19B, counters 51 and 52 for independently obtaining print duties in units of nozzle regions are arranged, and the head temperature is presumed from the independently obtained print duty to independently set a pre-ejection condition. Thus, a head temperature prediction error due to the print duty can be eliminated, and more stable ejection can be expected. In FIG. 19B, a host computer 50 is connected to the counters 51 and 52. The same reference numerals in FIG. 19B denote the same parts as in FIG. 5.

(Fifth Embodiment)

In this embodiment, an average head temperature during a predetermined past period is presumed from a reference temperature sensor provided for a main body, and the print duty, and a predetermined restoration means is operated at intervals optimally set according to the average head temperature. In this embodiment, the restoration means controlled according to the average head temperature includes pre-ejection and wiping, which are performed at predetermined time intervals during printing (in a cap open state) so as to stabilize ejection. As is well known in the ink-jet technique, the pre-ejection is performed for the purpose of preventing a non-ejection state or a change in density caused by evaporation of an ink from nozzle ports. Paying attention to the fact that the ink evaporation quantity varies depending on the head temperature, this embodiment sets an optimal pre-ejection interval and an optimal number of times of pre-ejection according to the average head temperature, so as to perform efficient pre-ejection from the viewpoints of time or ink consumption.

In open-loop control as the principal constituting element of this embodiment, i.e., a method of calculating and presuming a temperature at that time on the basis of the temperature detected by a reference temperature sensor provided for the main body, and the past print duties, an average head temperature during a predetermined past period required in this embodiment can be easily obtained. This embodiment pays attention to the fact that the ink evaporation quantity is associated with head temperatures at respective timings, and a total ink evaporation quantity during a predetermined period has a strong correlation with an average head temperature during that period. On the other hand, in a method of directly detecting the head temperature, it is relatively easy to perform real-time control according to head temperatures at respective timings. However, a special storage arithmetic circuit is necessary for obtaining a past average head temperature necessary for the control of this embodiment.

The wiping as another ejection stabilization means to be controlled by this embodiment is performed for the purpose of removing an unnecessary liquid such as an ink or water vapor, or a solid foreign matter such as paper, powder dust or the like, attached on an orifice formation surface. This embodiment pays attention to the fact that the wet quantity due to an ink varies depending on the head temperature, and evaporation of a wet component that makes it difficult to remove an ink or a foreign matter is associated with the head temperature (the temperature of the orifice formation surface). Thus, an optimal wiping interval is set according to the past average head temperature, thus efficiently performing wiping. The wet quantity or evaporation of the wet component associated with the wiping has a stronger correlation with the past average head temperature than with the head temperature at a time when the wiping is executed. Therefore, a head temperature presumption means of this embodiment is suitable.

Figure 20:
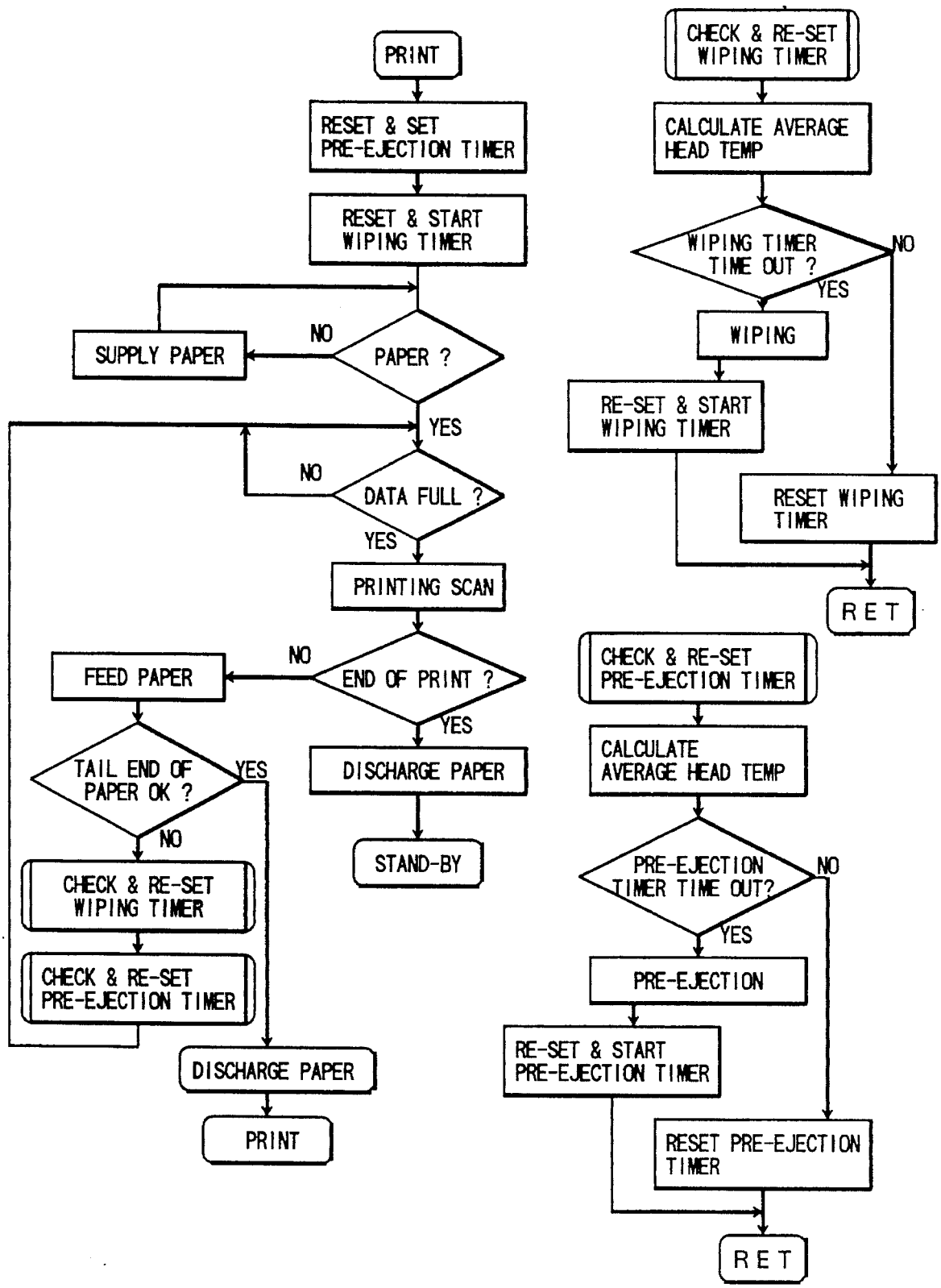
FIG. 20 is a flow chart showing a schematic print sequence.

FIG. 20 is a flow chart showing a schematic print sequence of an ink-jet recording apparatus of this embodiment. When a print signal is input, the print sequence is executed. A pre-ejection timer is set according to an average head temperature at that time, and is started. A wiping timer is similarly set according to the average head temperature at that time, and is started. If no paper sheet is detected, a paper sheet is fed, and a carriage scan (print scan) operation is performed to print one line upon completion of a data input operation.

If the print operation is ended, the paper sheet is discharged, and a stand-by state is set. If the print operation is continued, the paper sheet is fed by a predetermined amount, and it is then checked if its tail end is detected. The wiping timer and the pre-ejection timer, which are set according to the average head temperature, are checked and re-set. Wiping or pre-ejection is performed as needed, and the timers are started again. At this time, an average head temperature is calculated independently of the presence/absence of an operation, and the wiping timer and the pre-ejection timer are re-set according to the calculated average head temperature.

In this embodiment, wiping and pre-ejection timings are finely re-set according to a change in average head temperature in units of print lines, so that optimal wiping and pre-ejection can be performed according to ink evaporation and wet situations. The control waits for completion of the data input operation after the predetermined restoration operation, and the above-mentioned steps are repeated to perform the print scan operation again.

Table 10 below is a correspondence table of the pre-ejection interval, and the number of times of pre-ejection according to an average head temperature for the last 12 sec, and is also a correspondence table of the wiping interval according to an average head temperature for the last 48 sec. In this embodiment, as the average head temperature becomes higher, the pre-ejection interval is shortened to decrease the number of times of pre-ejection. Contrary to this, as the average head temperature becomes lower, the pre-ejection interval is prolonged to increase the number of times of pre-ejection. Such a setting operation may be properly made in consideration of characteristics such as ejection characteristics according to evaporation·viscosity increase characteristics of an ink, and a change in density. For example, in the case of an ink, which contains a large amount of a nonvolatile solvent, and is presumed to suffer from a decrease in viscosity due to a temperature rise rather than an increase in viscosity due to evaporation, the pre-ejection interval may be prolonged at a high temperature.

TABLE 10

| Head Presumed | Presumption for Last 12 Sec Pre-ejection | | Presumption for Last 48 Sec Wiping | Presumption for Last 12 Hours Suction |
|---|---|---|---|---|
| Temperature (°C.) | Interval (sec) | No. of Pulses | Interval (sec) | Interval (hours) |
| 20 to 30 | 12 | 16 | 48 | 72 |
| 30 to 40 | 9 | 12 | 36 | 60 |
| 40 to 50 | 6 | 8 | 24 | 48 |
| Over 50 | 3 | 4 | 12 | 3 |

As for the wiping, a normal liquid ink tends to increase the wet quantity and difficulty of removal as the temperature becomes higher. In this embodiment, wiping is frequently performed at a high temperature. This embodiment exemplifies a case of one recording head. In an apparatus, which realizes a color print operation, or a high-speed operation using a plurality of heads, a restoration condition may be controlled according to an average head temperature in units of recording heads, or the plurality of heads may be simultaneously driven in correspondence with a recording head having the shortest interval.

(Sixth Embodiment)

This embodiment exemplifies a suction restoration means according to a presumed value of a past average head temperature for a relatively long period of time as another example of restoration control based on presumption of an average head temperature like in the fifth embodiment. A recording head of an ink-jet recording apparatus is often arranged to attain a negative head at nozzle ports for the purpose of stabilizing a meniscus shape at the nozzle ports. An unexpected bubble in an ink channel causes various problems in the ink-jet recording apparatuses, and particularly poses a problem in a system maintained at a negative head.

More specifically, when the apparatus is left without performing a recording operation, a bubble, which disturbs normal ejection, grows in the ink channel due to dissociation of a gas dissolved in an ink or gas exchange through channel constituting members, thus posing a problem. The suction restoration means is prepared for the purpose of removing such a bubble in the ink channel, and an ink whose viscosity is increased due to evaporation in the distal end portion of a nozzle port. The ink evaporation quantity changes depending on the head temperature, as described above. The growth of a bubble in the ink channel is further easily influenced by the head temperature, and a bubble tends to be formed as the temperature becomes higher. In this embodiment, as shown in Table 10, a suction restoration interval is set according to the average head temperature for the last 12 hours, and suction restoration is performed more frequently as the average head temperature is higher. The average temperature may be re-set for every page.

When the past average head temperature is presumed over a relatively long period of time using a plurality of heads, as shown in FIG. 4, the plurality of heads are thermally coupled., and then, the average head temperature is presumed on the basis of the average duty of the plurality of heads, and the temperature detected by a reference temperature sensor in the main body, so as to perform simple control under an assumption that the plurality of heads are almost equal to each other. In FIG. 4, thermal coupling of the heads is realized by directly mounting the base portions, having high thermal conductivity, of the recording heads on a carriage, which is partially (including a common support portion of the heads) or entirely formed of a material having high thermal conductivity such as aluminum.

(Seventh Embodiment)

In this embodiment, a restoration system is controlled according to the hysteresis of a temperature presumed from the temperature detected by a reference temperature sensor arranged in the main body, and the print duty.

A foreign matter such as an ink is often deposited on an orifice formation surface to shift the ejection direction or to cause an ejection error. As a means for restoring deterioration of ejection characteristics, a wiping means is arranged. In some cases, a wiping member having a stronger scrubbing force may be prepared, or a wiping condition is temporarily changed to enhance a wiping effect. In this embodiment., the entrance amount (thrust amount) of a wiping member formed of a rubber blade into the orifice formation surface is increased to temporarily enhance a wiping effect (scrubbing mode).

It was experimentally demonstrated that deposition of a foreign matter requiring scrubbing was associated with the wet ink quantity, the non-wiped quantity upon wiping, and its evaporation, and a correlation between the number of times of ejection and the temperature upon ejection was strong. Therefore, in this embodiment, the scrubbing mode is controlled according to the number of times of ejection weighted by the head temperature. Table 11 shows weighting coefficients, which are multiplied with the number of times of ejection as base data of a print duty according to a head temperature presumed from the print duty. More specifically, at a higher temperature that easily causes a wet ink or non-wiped ink, the number of times of ejection serving as an index of deposition is increased in control.

TABLE 11

| Head Presumed Temperature (°C.) | Weighting Coefficient of Number of Pulses |
|---|---|
| 20 to 30 | 1.0 |
| 30 to 40 | 1.2 |
| 40 to 50 | 1.4 |
| Over 50 | 1.6 |

When the weighted number of times of ejection reaches five million, the scrubbing mode is operated. The scrubbing mode is effective for removing a deposit. However, since the scrubbing force is strong, the orifice formation surface may be mechanically damaged, and hence, execution of the scrubbing mode is preferably minimized. When control is made based on data directly correlated to deposition of a foreign matter like in this embodiment, an arrangement can be simple, and high reliability is assured. In a system having a plurality of heads, for example, the print duty is managed in units of colors, and the scrubbing mode may be controlled in units of ink colors having different deposition characteristics.

(Eighth Embodiment)

This embodiment also exemplifies a suction restoration means like in the sixth embodiment. In this embodiment, presumption of a bubble formed upon printing (print bubble) is performed in addition to presumption of a bubble due to a non-print state (non-print bubble), thus allowing accurate presumption of bubbles in an ink channel. As described above, the ink evaporation quantity changes according to the head temperature. The growth of a bubble in the ink channel is further easily influenced by the head temperature, and a bubble tends to grow more easily as the temperature is higher. As can be seen from the above description, a non-print bubble can be presumed by counting a non-print time weighted by the head temperature.

A print bubble tends to be formed as the head temperature is higher, and of course, has a positive correlation with the number of times of ejection. Thus, the print bubble can also be presumed by counting the number of times of ejection weighted by the head temperature. In this embodiment, as shown in Table 12 below, the number of points according to a non-print time (non-print bubble), and the number of points according to the number of times of ejection (print bubble) are set, and when a total of points reaches 100 million, it is determined that bubbles in the ink channel may adversely influence ejection, and a suction restoration operation is performed to remove the bubbles.

TABLE 12

| Head Temperature (°C.) | Number of Points According to Non-print Time (points/sec) | Number of Points According to Number of Dots (points/sec) |
|---|---|---|
| 20 to 30 | 385 | 46 |
| 30 to 40 | 455 | 56 |
| 40 to 50 | 588 | 65 |
| Over 50 | 769 | 74 |

Matching between the points of print and non-print bubbles was experimentally determined, so that the same points were obtained when an ejection error is caused by each factor under the same temperature condition. Weighting coefficients according to the temperature were also experimentally obtained, and the obtained values are converted. As a bubble removal means, either the suction means of this embodiment or compression means may be employed. Alternatively, after an ink in the ink channel is removed by a certain method, the suction means may be operated.

In each of the third to eighth embodiments, the ejection quantity control described in the first and second embodiments may or may not be performed together. When no ejection quantity control is made, steps associated with PWM control and sub-heater control can be omitted.

As described above, according to the present invention, the ejection quantity can be controlled to be constant without arranging a temperature sensor in a recording head, and restoration processing can be properly performed. Therefore, a good recording image can be obtained independently of the precision of the temperature sensor.

(Ninth Embodiment)

In each of the above embodiments, a change in temperature of a head is detected from the past to the present time by calculation processing, thereby presuming a head temperature.

(Summary of Temperature Prediction)

In this embodiment, upon execution of a recording operation by ejecting an ink droplet from a recording head, a surrounding temperature sensor for measuring the surrounding temperature is provided for a main body side, and a change in head temperature from the past to the present time, and also from the present time to the future is detected by calculation processing, so that optimal temperature control can be performed without arranging a head temperature sensor having a correlation with the head temperature. Briefly speaking, a change in head temperature is predicted by evaluating it using a matrix calculated in advance within a range of a thermal time constant of the head and an applicable energy.

(Temperature Prediction Control)

Figure 11:
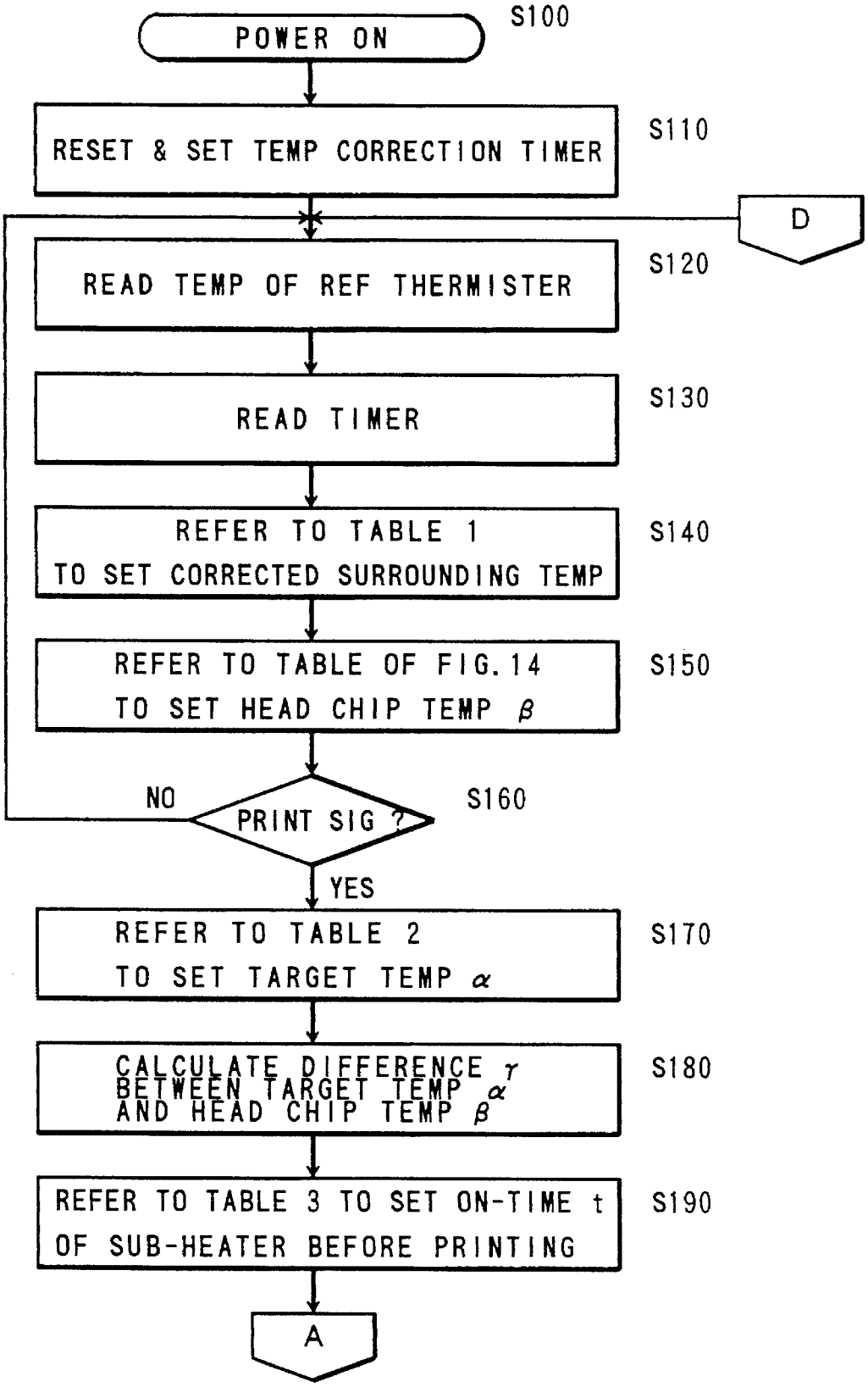
FIG. 11 to 13 are flow charts associated with temperature correction control.
Figure 12:
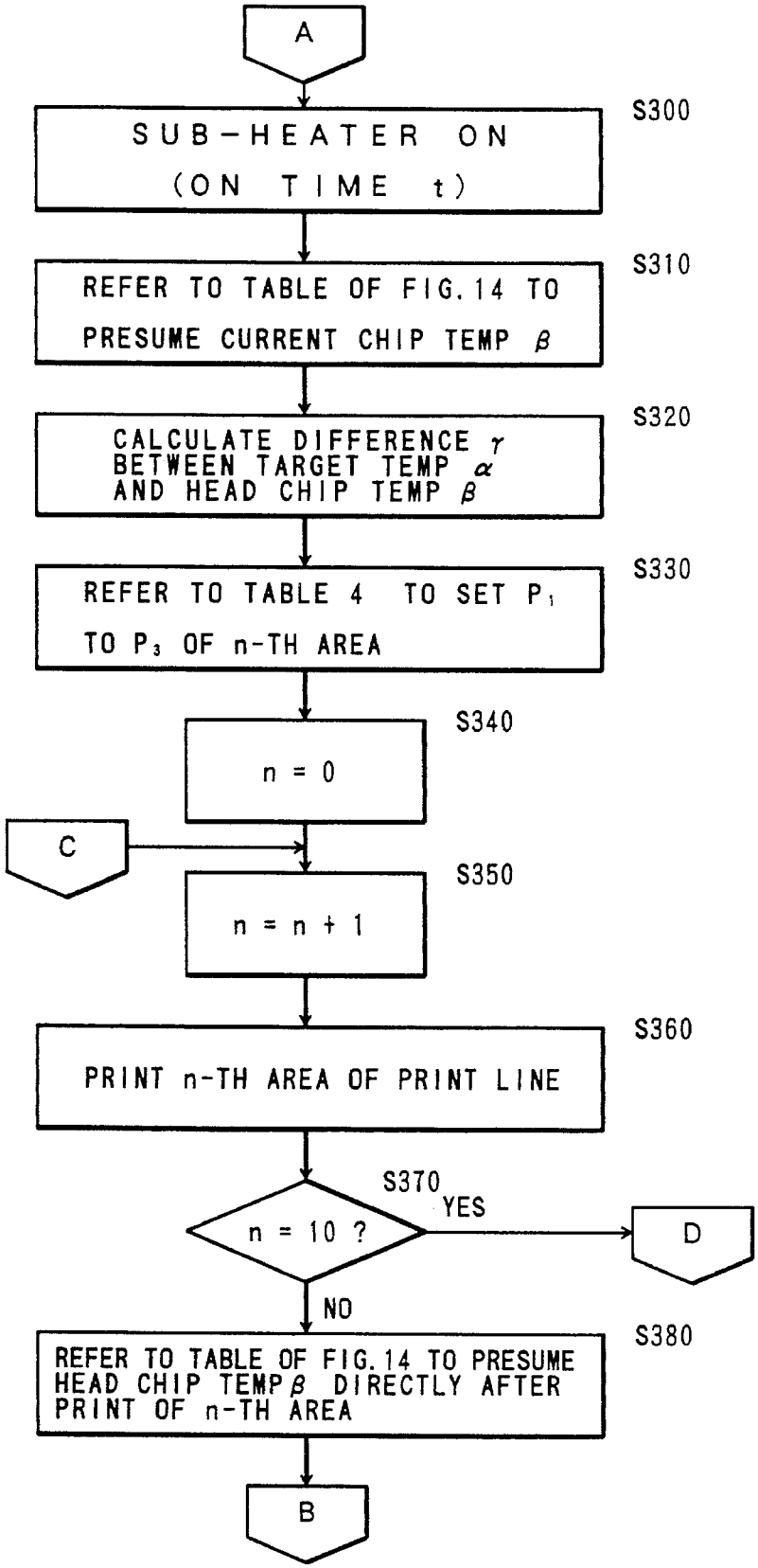
Figure 22:
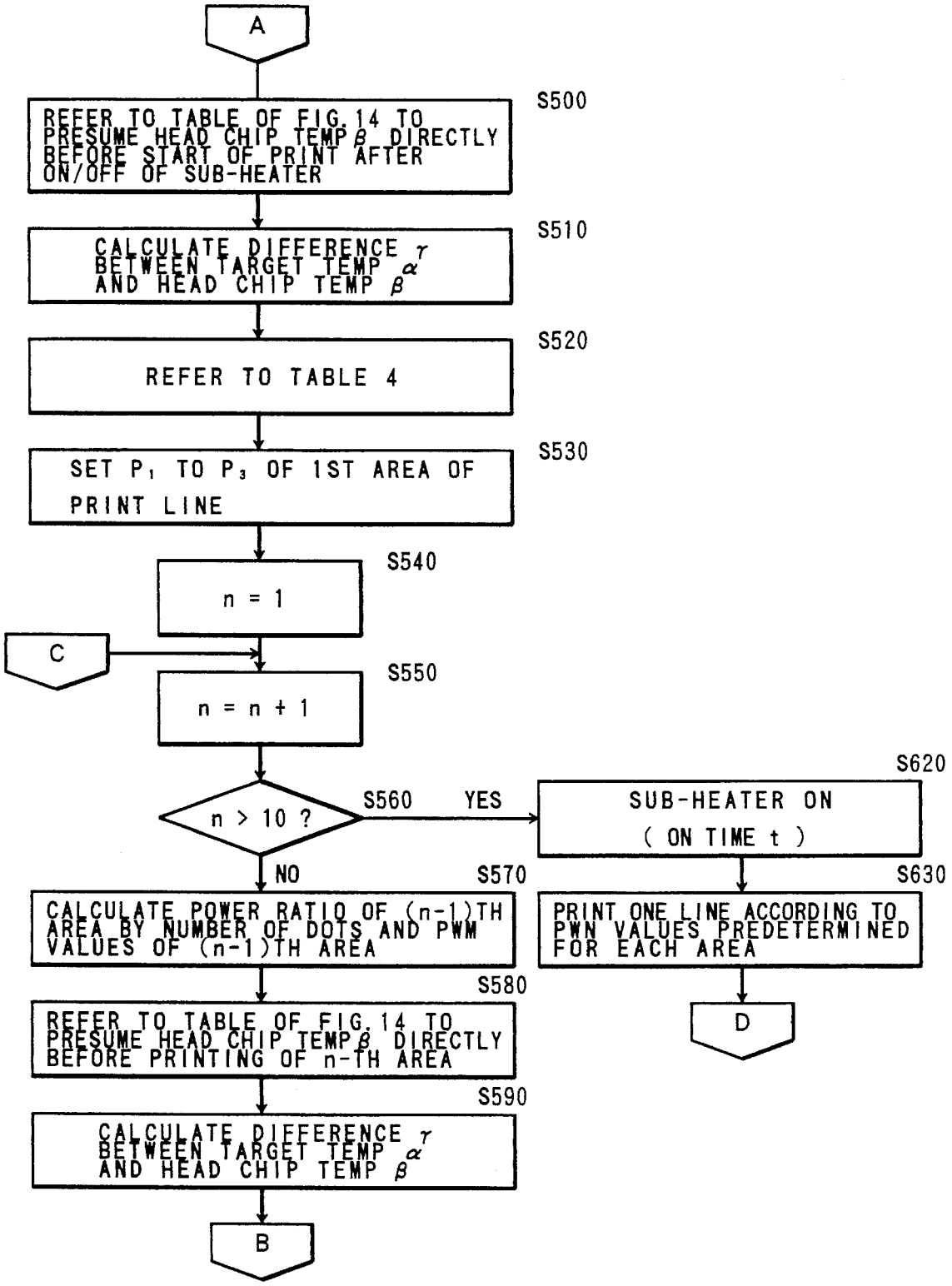
Figure 23:
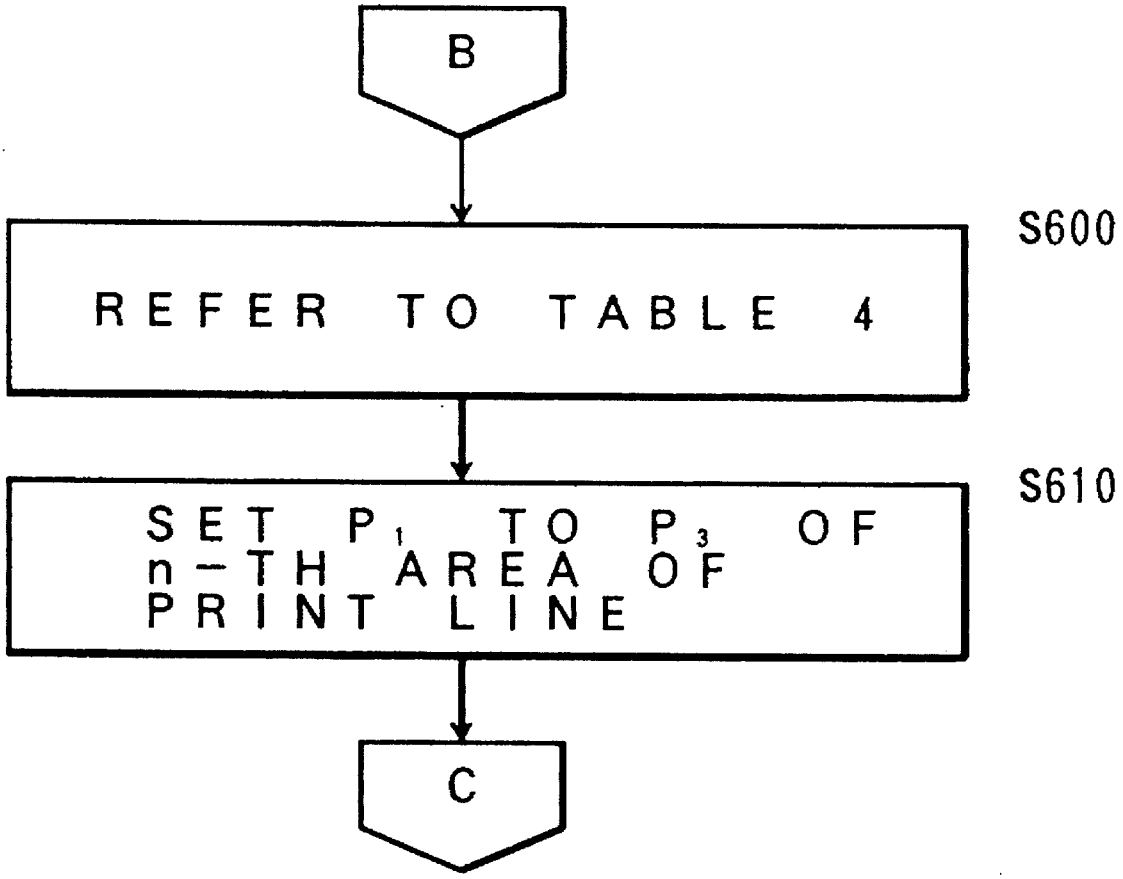

The operation of this embodiment will be described below with reference to the flow charts shown in FIG. 11 presented previously, and FIGS. 22 and 23. Note that a description of steps S100 to S190 shown in FIG. 11 will be omitted. In the above embodiment, the table shown in FIG. 14 is called the "temperature presumption table". However, in this embodiment, this table will be called a "temperature prediction table".

When matrix values are accumulated on the basis of this table in every unit time, a head temperature at that time can be presumed, and future print data or an energy to be applied to the head such as a sub-heater in future is input, thus predicting a change in head temperature in future.

In step S180 in FIG. 11, a difference $\gamma$ ($=\alpha-\beta$) between a print target temperature ($\alpha$) and a current head chip temperature ($\beta$) is calculated. In step S190, a sub-heater control table (Table 3) is referred to, thus obtaining an ON time (t) of the sub-heater before the print operation for the purpose of decreasing the difference ($\gamma$). This is a function of increasing the temperature of the entire head chip by the sub-heater when the presumed temperature of the head and the target temperature have a difference therebetween at the beginning of the print operation. Thus, the temperature of the entire head chip can be controlled to be close to the target temperature as much as possible. Note that a heater ON operation in step S300 in the first embodiment is not performed in this embodiment.

After the ON time (t) of the sub-heater before printing is obtained, the temperature prediction table (FIG. 14) is referred to, thus predicting a (future) head chip temperature immediately before printing when the sub-heater is assumed to be turned on for the setting time (S500). A difference ($\gamma$) between the print target temperature ($\alpha$) and the predicted head chip temperature ($\beta$) is calculated (S510). Needless to say, it is desirable that the temperatures ($\alpha$) and ($\beta$) are equal to each other. Even when these two temperatures are not equal to each other, a PWM value at the start of the print operation is set according to the difference ($\gamma$) with reference to the PWM value determination table (Table 4), so that an ejection quantity equal to that obtained in the print operation at the print target temperature ($\alpha$) is obtained (S520, S530). It is difficult to cause the chip temperature to precisely approach the target temperature even using the sub-heater, and furthermore, it is very difficult to perform temperature correction in one line by the sub-heater. Thus, in this embodiment, the ejection quantity is corrected by the PWM method in accordance with the remaining difference from the target value. In particular, in this embodiment, the above-mentioned value P1 is increased to increase the ejection quantity.

The chip temperature of the head changes in accordance with its ejection duty during a one-line print operation. More specifically, since the difference ($\gamma$) sometimes changes even in one line, it is desirable to optimize a PWM value in one line according to the change in difference. In this embodiment, 1.0 sec is required to print one line. Since the temperature prediction cycle of the head chip is 0.1 sec, one line is divided into 10 areas in this embodiment. The previously set PWM value at the beginning of the print operation corresponds to one at the beginning of the first area.

A method of determining PWM values at the beginning of the second to 10th areas will be described below. In step S540, n=1 is set, and n is incremented in step S550. Note that n indicates an area. Since there are 10 areas, when n exceeds 10, the control escapes from the following loop (S560).

In the first loop, the PWM value at the beginning of the second area is set. As a method, a power ratio of the first area is calculated based on the number of dots and the PWM value of the first area (S570).

A head chip temperature upon completion of the print operation of the first area (i.e., at the beginning of the print operation of the second area) is predicted by substituting the power ratio in (with reference to) the temperature prediction table (FIG. 14) (S580). In step S590, a difference ($\gamma$) between the print target temperature ($\alpha$) and the head chip temperature ($\beta$) is calculated again. A PWM value for printing the second area is obtained according to the difference ($\gamma$) with reference to the PWM value determination table (Table 4), and the PWM value for the second area is set on a memory (S600, S610).

Thereafter, the power ratio in each subsequent area is calculated on the basis of the number of dots and the PWM value of the area, and a head chip temperature ($\beta$) upon completion of the print operation of the corresponding area is predicted. Then, a PWM value of the next area is set according to a difference between the print target value ($\alpha$) and the predicted head chip temperature ($\beta$) (S550 to S610).

After the PWM values of all the 10 areas in one line are set, the flow advances from step S560 to step S620, and the heating operation of the sub-heater before printing is performed. Thereafter, a one-line print operation is performed according to the set PWM values (S630). When the one-line print operation is ended in step S630, the flow returns to step S120 to read the temperature of a reference thermistor, and the above-mentioned control is sequentially repeated.

Under the above-mentioned control, the head chip temperature ($\beta$) gradually approaches the print target temperature ($\alpha$). Even if a large temperature difference is present between the head chip temperature ($\beta$) and the print target temperature ($\alpha$) like in an early period after power-ON, since PWM control is performed within one line, an actual ejection quantity can be controlled like that at the print target temperature, and high quality can be realized.

Note that the control operation of this embodiment is executed by a CPU 60 shown in FIG. 5. The CPU 60 can obtain print duties of the respective areas with reference to line duty buffers 78*c* during temperature prediction control like in the first embodiment. Therefore, an arithmetic load on the CPU 60 can be reduced.

The temperature prediction control will be explained in detail below with reference to the explanatory views shown in FIGS. 15A to 16E like in the first embodiment. First, a difference between the surrounding temperature and the head temperature is calculated to check if the heating operation of the sub-heater immediately before printing is necessary. In FIG. 15B, since the head temperature is not largely shifted from the target temperature, the heating operation of the sub-heater is not performed (FIG. 15D). The head temperature (FIG. 15B) immediately before printing of an area A1 is predicted, and a PWM value (FIG. 15C) for the area A1 is set according to the difference. In this case, it is determined based on the PWM value of the area A1 that the area A1 is printed with a duty of 100%, and the temperature immediately before printing of the next area A2 is predicted.

Since the duty of the area A1 is high, it can be predicted that the temperature immediately before printing of the area A2 is high, and a low PWM value is set. Since the area A2 has a low duty (0%) and low PWM value, it can be predicted that the temperature immediately before printing of an area A3 is decreased. Therefore, a large PWM value immediately before printing of an area A4 is set.

In areas A4, A5, A6, and A7, since actual print duties are high, it can be predicted that the head temperature is gradually increased, and the PWM values are gradually decreased. After an area AS, since actual print duties are low, it can be predicted that the head temperature is gradually decreased, and the PWM values are gradually increased. As described above, the PWM value upon printing of each area is set based on the presence/absence of use and power of the sub-heater before printing, and the head temperature predicted value immediately before printing of each area, and thereafter, the print operations are performed. Since it can be predicted that the head temperature (FIG. 15B) will not be largely shifted from the reference temperature in the one-line print operation, the sub-heater is not turned on immediately before printing of the next line.

In FIGS. 16A to 16E, a difference between the surrounding temperature and the head temperature is calculated to check if the heating operation of the sub-heater immediately before printing is necessary. In this case, since the head temperature is largely shifted from the target temperature, it is predicted that the heating operation of the sub-heater is necessary, and the heating operation of the sub-heater is performed (FIG. 16D). Then, a head temperature upon completion of the heating operation of the sub-heater and immediately before printing of the area A1 (FIG. 16B) is predicted. Since it is predicted that the head temperature exceeds the target temperature, a minimum value is assigned to the PWM value (FIG. 16C) upon printing of the area A1. Although the heating operation of the sub-heater can increase the temperature in an early period of the heating operation, since the difference between the head temperature and the target temperature is large, it can be easily predicted that the head temperature is decreased below the reference temperature upon completion of printing. Therefore, the head temperature immediately after the sub-heater is turned on is intentionally set to exceed the target temperature.

The minimum value is assigned to the PWM value of the area A1. However, since the duty (100%) of the area A1 is high, it is predicted that the temperature immediately before printing of an area A2 is not decreased below the target temperature, and a minimum PWM value is set for the area A2. In areas A2 and A3, since actual print duties are small, the head temperature is gradually decreased to a temperature below the target temperature, and optimal PWM values are set. Thereafter, the heating operation of the sub-heater and the actual print operations are performed, while setting the PWM values of the areas in the same manner as in FIGS. 15A to 15E.

A difference between the cases in FIGS. 15A to 15E and FIGS. 16A to 16E is that the ejection quantity does not exceed the ejection quantity (FIG. 15E) at the target temperature in the former case, while the ejection quantity sometimes exceeds the ejection quantity (FIG. 16E) at the target temperature in the latter case. This is because no negative PWM value for decreasing the ejection quantity is set in this embodiment. In a practical application, a negative PWM value may be provided.

In this embodiment, since a future head temperature can be predicted without using a temperature sensor, various head control operations can be performed before an actual print operation, and a more proper recording operation can be attained. Since it is possible to predict a temperature with reference to one temperature prediction table, prediction control can be facilitated.

The temperature prediction described in the ninth embodiment can be applied to each of the third to eighth embodiments described previously. The head temperature is not limited to a presumed temperature at the present time, and a future head temperature can also be easily predicted. Therefore, the optimal pre-ejection interval and the optimal number of times of pre-ejection may be set in consideration of a future ejection condition. In addition, optimal suction restoration control may set. Furthermore, the "weighted number of times of ejection" taking a future ejection condition into consideration may be used in a calculation of the "weighted number of times of ejection" to set optimal control.

Moreover, "ink evaporation characteristics" or "growth of bubbles in an ink channel" taking a future ejection condition into consideration may be used in presumption or prediction of the "ink evaporation characteristics" or "growth of bubbles in an ink channel" to set optimal control.

(Tenth Embodiment)

The tenth embodiment of the present invention will be described below with reference to the accompanying drawings. In this embodiment, a temperature sensor is provided for a recording head, and a predicted (calculated) head temperature is corrected to improve prediction precision.

Figure 24:
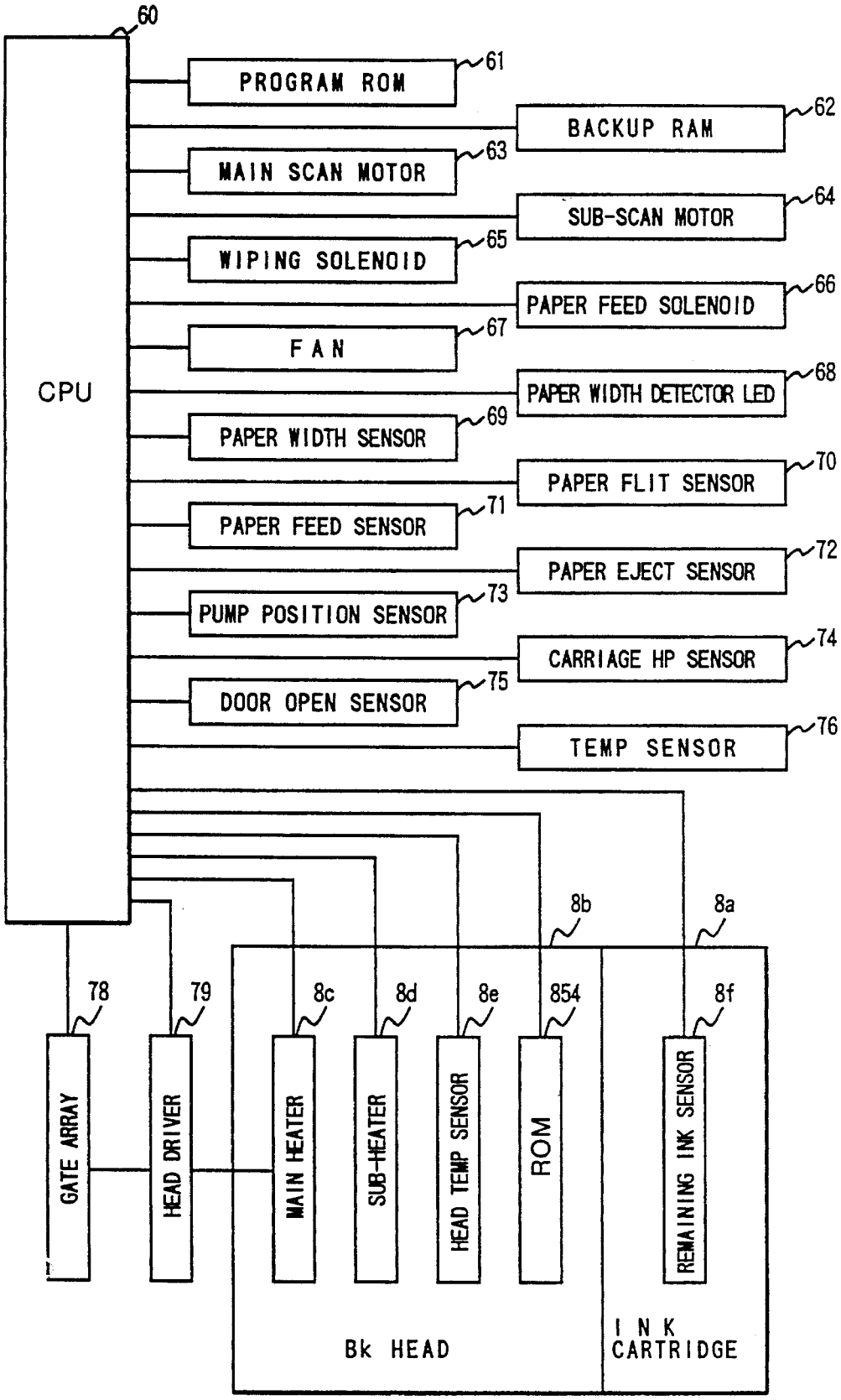
FIG. 24 is a block diagram showing another control arrangement for executing a recording control flow.

In the arrangement of this embodiment, as shown in FIG. 24, a head 8*b* has a temperature sensor 8*e*, and a head temperature detected by the temperature sensor 8*e* can be detected by a CPU 60.

(Detection of Recording Head Temperature)

Figure 25:
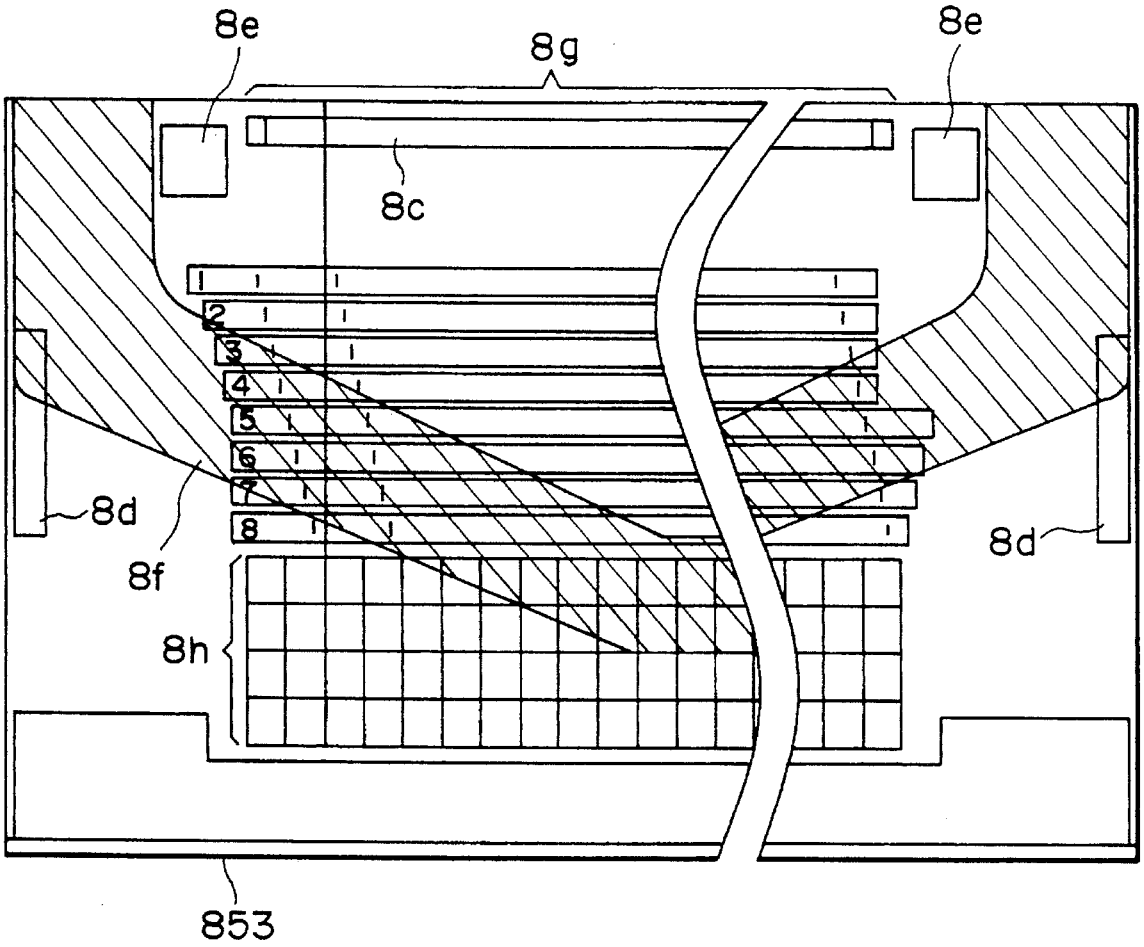
FIG. 25 is a view showing in detail a head.

FIG. 25 shows a heater board of a recording head, which can be used in this embodiment. A temperature sensor, a temperature control heater, an ejection heater, and the like are arranged on the heater board.

FIG. 25 is a schematic plan view of the heater board. In FIG. 25, the temperature sensors 8*e* are arranged at both the right and left sides of an array of a plurality of ejection heaters 8*c* on an Si substrate 853. These ejection heaters 8*c* and the temperature sensors 8*e* are pattern-arranged together with temperature control heaters 8*d* similarly arranged at both the right and left sides of the heater board, and are simultaneously formed in a semiconductor process. In this embodiment, as the temperature detected by the temperature sensor 8*e*, an average value of temperatures detected by the two temperature sensors 8*e* is used.

(Operation Flow)

Figure 13:
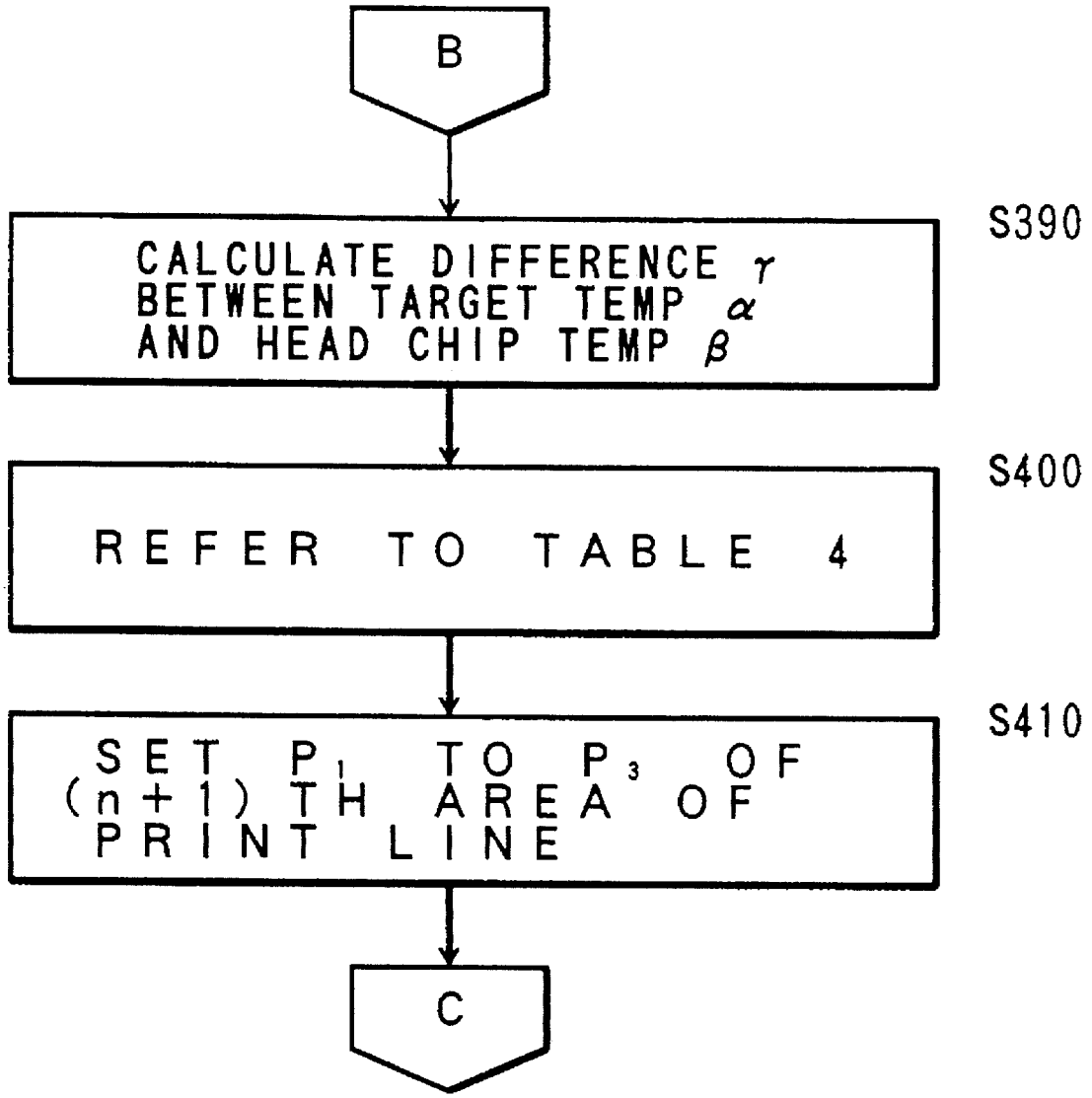
Figure 26:
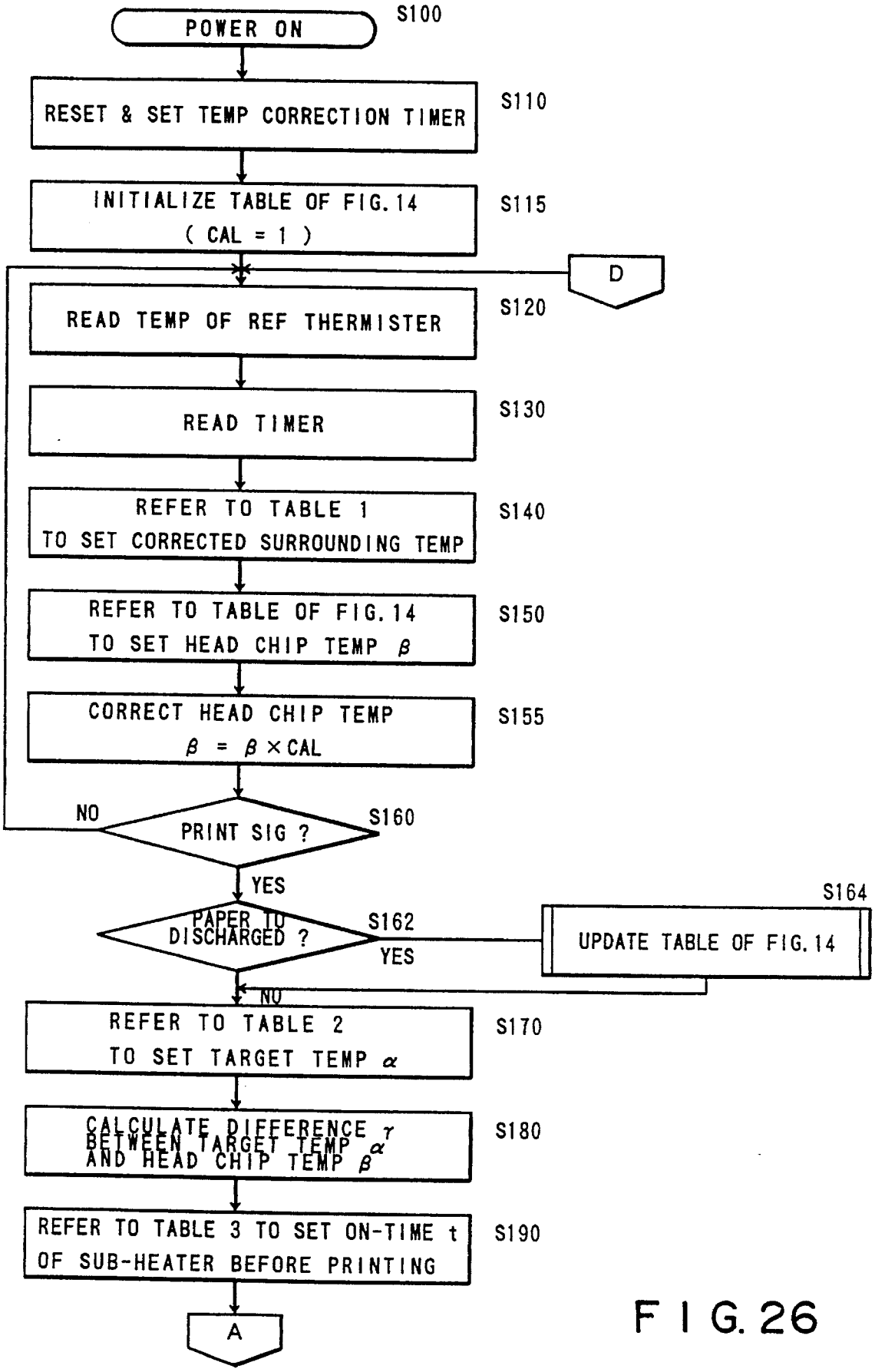
FIGS. 26 to 28 are flow charts associated with another temperature prediction control.
Figure 27:
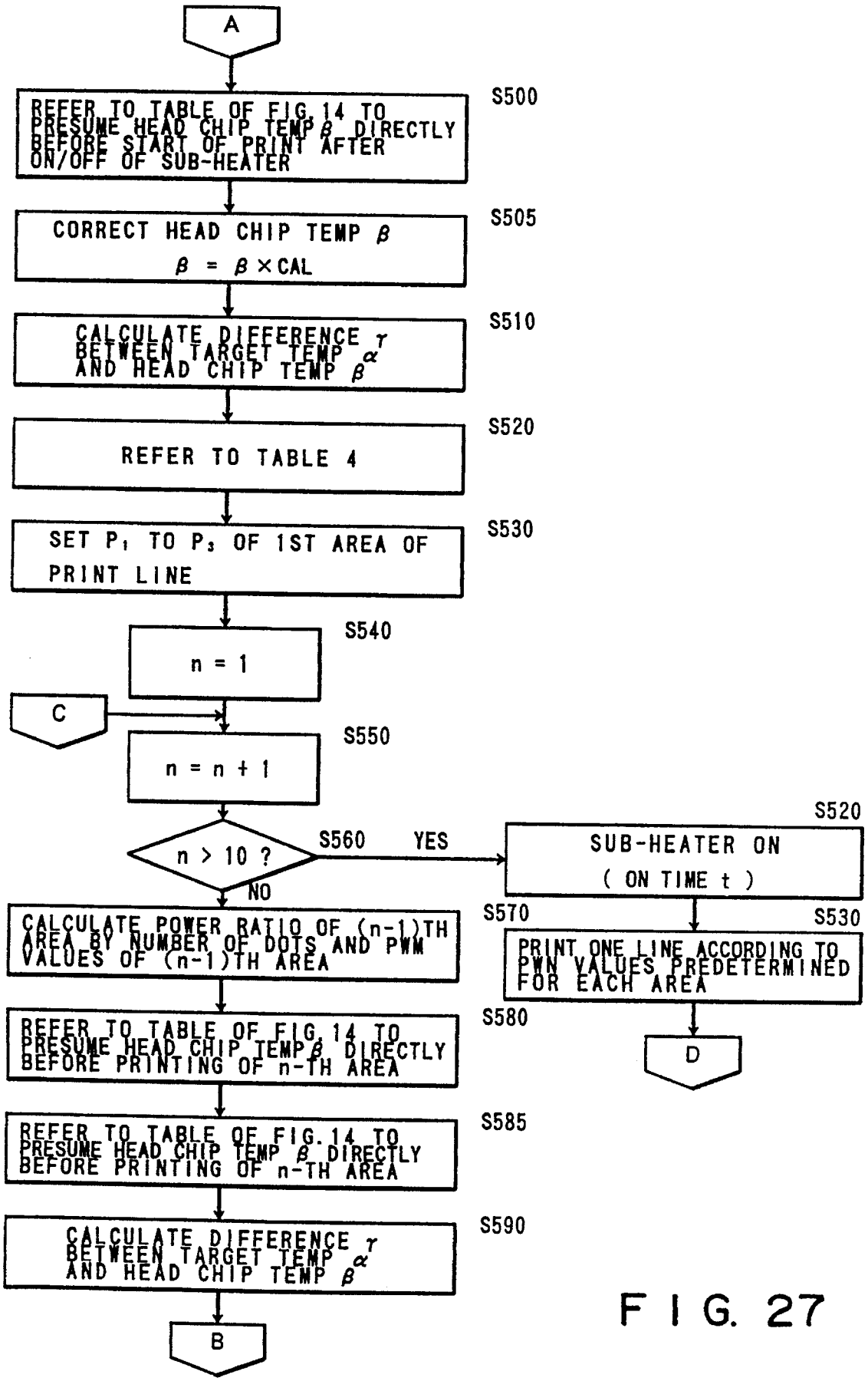
Figure 28:
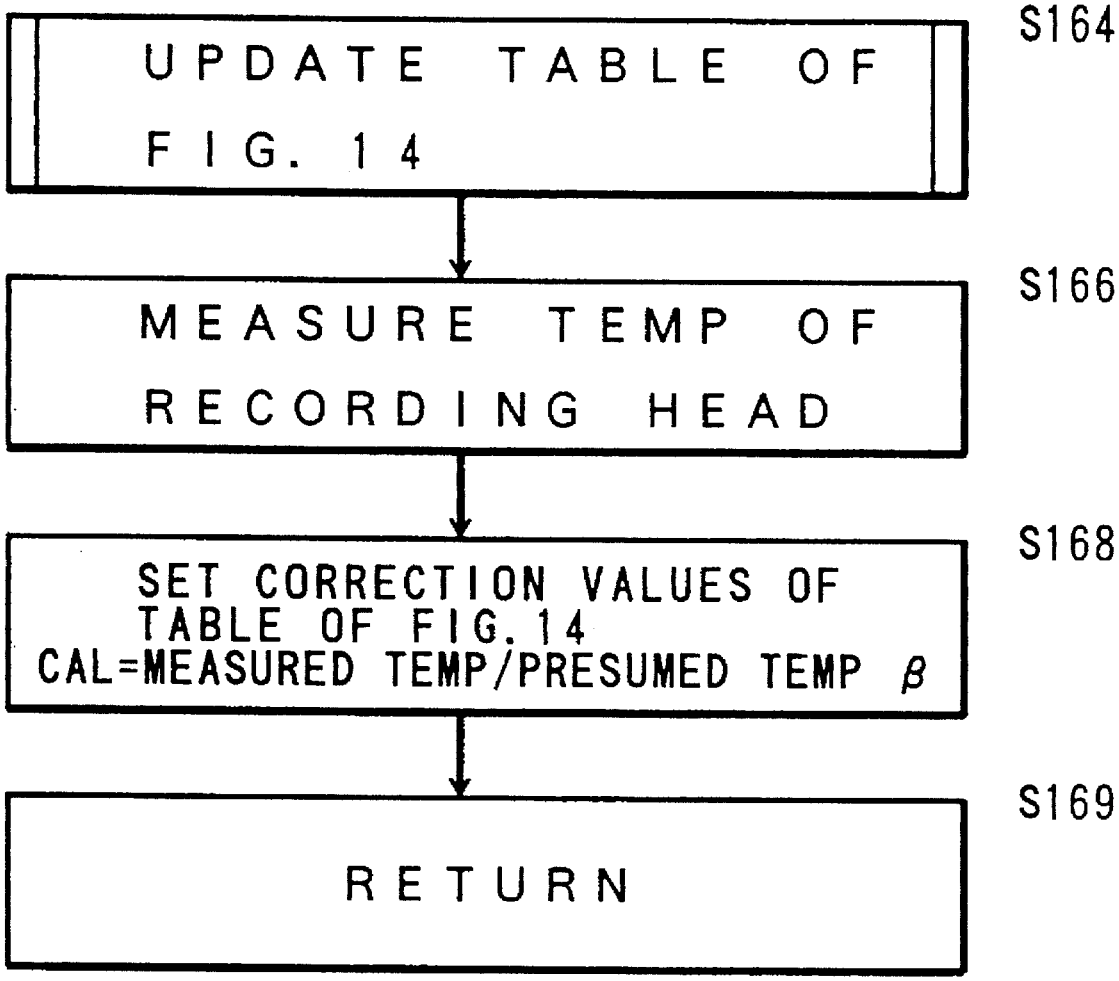

An operation when a recording operation is performed using the recording apparatus with the above arrangement will be described below with reference to the flow charts shown in FIG. 13 presented previously, and FIGS. 26 to 28.

When a power supply is turned on in step S100, a temperature correction timer is reset/rest (S110), and a temperature prediction table correction value "CAL" is initialized (CAL=1) (S115). The temperature detected by a temperature sensor (to be referred to as a reference thermistor hereinafter), on a main body printed circuit board (to be referred to as a PCB hereinafter), for detecting the surrounding temperature is read (S120), thus detecting the surrounding temperature. A time elapsed from the ON operation of the power supply is read from the temperature correction timer (S130), and a precise surrounding temperature from which the influence of heat generating members is corrected is obtained with reference to a temperature correction table (Table 1) (S140).

In step S150, a current head chip temperature (β) is predicted with reference to a temperature prediction table (FIG. 14), and the control waits for input of a print signal. The current head chip temperature (β) is predicted as follows. That is, the surrounding temperature obtained in step S140 is updated by adding a value determined by a matrix of a temperature difference between the head temperature and the surrounding temperature with respect to an applied energy (power ratio) of the head per unit time, and the updated surrounding temperature is multiplied with the correction value "CAL" (β=β*CAL) (S155). Immediately after the ON operation of the power supply, no print signal is input (applied energy =0), a temperature difference between the head temperature and the surrounding temperature is 0, and the correction value "CAL" is also 1. Therefore, a matrix value 0 (thermal equilibrium) is added to the surrounding temperature, and the sum is multiplied with 1. If no print signal is input, the flow returns to step S120 to read the temperature of the reference thermistor again. In this embodiment, the head chip temperature prediction cycle is set to be 0.1 sec.

The temperature prediction table shown in FIG. 14 is a matrix table showing temperature rise characteristics per unit time, determined by the thermal time constant of the head and an energy applied to the head, as described above. Strictly speaking, since the thermal time constant of the head varies depending on heads, the temperature rise characteristics may slightly vary. The correction value "CAL" for the temperature prediction table is a coefficient for correcting this variation.

When a print signal is input, the control is made as follows.

Prior to execution of a print operation, it is checked if a paper feed/discharge operation of a recording medium is performed (S162). If YES in step S162, the flow branches to a temperature prediction table correction routine (S164). In the temperature prediction table correction routine, a value in the temperature prediction table is corrected. More specifically, as shown in FIG. 28, the temperature of the head chip is measured by the head temperature sensor (S166), and a ratio of the measured temperature to a head chip temperature predicted in the temperature prediction table is obtained. This ratio is set in "CAL" (CAL=sensor value/predicted value "β") (S168). As described above, since the thermal time constant of the head varies in units of heads in a strict sense, the acceleration (inclination) of a temperature rise with respect to an applied energy varies in units of heads, and a small difference from the temperature prediction table is often generated. This difference, i.e., the result of the acceleration of the temperature rise with respect to the applied energy is obtained as "CAL" (CAL=sensor value/predicted value "β"), thereby correcting the following predicted values of a head chip temperature. After the correction value is obtained, the flow returns to step S170 in the main routine (S169).

The reason why the temperature of the head temperature sensor is read during a paper feed/discharge period is that a change in temperature is steady since the head is not driven (heated), and the influence of a delay of heat conduction is small.

In step S170, a print target temperature (α) of the head chip, at which an optimal driving operation can be performed at the current surrounding temperature, is obtained with reference to a target (driving) temperature table (Table 2).

In step S180, a difference γ (=α−β) between the print target temperature (α) and the current head chip temperature (β) is calculated. In step S190, an ON time (t) of a sub-heater before printing for the purpose of decreasing the difference (γ) is obtained with reference to a sub-heater control table (Table 3).

After the ON time (t) of the sub-heater before printing is obtained, the temperature prediction table (FIG. 14) is referred to, thereby predicting a (future) head chip temperature immediately before the beginning of printing under an assumption that the sub-heater is turned on for the setting time (S500). The predicted temperature is corrected by the correction value CAL (S505), thereby setting the head chip temperature. A difference (γ) between the print target temperature (α) and the predicted head chip temperature (β) is calculated (S510). Needless to say, it is desirable that the temperatures (α) and (β) are equal to each other. Even when these two temperatures are not equal to each other, a PWM value at the start of the print operation is set according to the difference (γ) with reference to a PWM value determination table (Table 4), so that an ejection quantity equal to that obtained in the print operation at the print target temperature (α) is obtained (S520, S530).

The chip temperature of the head changes due to its ejection duty during a one-line print operation. More specifically, since the difference (γ) sometimes changes even in one line, it is desirable to optimize a PWM value in one line according to the change in difference. In this embodiment, 1.0 sec is required to print one line. Since the temperature prediction cycle of the head chip is 0.1 sec, one line is divided into 10 areas in this embodiment. The previously set PWM value at the beginning of the print operation corresponds to one at the beginning of the first area.

A method of determining PWM values at the beginning of the second to 10th areas will be described below. In step S540, n=1 is set, and n is incremented in step S550. Note that n indicates an area. Since there are 10 areas, when n exceeds 10, the control escapes from the following loop (S560).

In the first loop, the PWM value at the beginning of the second area is set. As a method, a power ratio of the first area is calculated based on the number of dots and the PWM value of the first area (S570).

A head chip temperature upon completion of the print operation of the first area (i.e., at the beginning of the print operation of the second area) is predicted by substituting the power ratio in (with reference to) the temperature prediction table (FIG. 14) (S580). The predicted temperature is corrected by the correction value CAL (S585), thus setting the head chip temperature β. In step S590, a difference (γ) between the print target temperature (α) and the head chip temperature (β) is calculated again. In FIG. 13 presented previously, a PWM value for printing the second area is obtained according to the difference (γ) with reference to the PWM value determination table (Table 4), and the PWM value for the second area is set on a memory (S600, S610).

Thereafter, the power ratio in the corresponding area is calculated on the basis of the number of dots and the PWM value of the immediately preceding area, and a head chip temperature (β) upon completion of the print operation of the corresponding area is predicted. The predicted temperature is corrected by the correction value CAL. Then, a PWM value of the next area is set according to the difference between the print target value (α) and the predicted head chip temperature (β) (S550 to S610). After the PWM values of all the 10 areas in one line are set, the flow advances from step S560 to step S620, and the heating operation of the sub-heater before printing is performed. Thereafter, a one-line print operation is performed according to the set PWM values (S630). When the one-line print operation is ended in step S630, the flow returns to step S120 to read the temperature of a reference thermistor, and the above-mentioned control is sequentially repeated.

Under the above-mentioned control, the head chip temperature (β) gradually approaches the print target temperature (α). Even if a large temperature difference is present between the head chip temperature (β) and the print target temperature (α) like in an early period after power-ON, since PWM control is performed within one line, an actual ejection quantity can be controlled like that at the print target temperature, and high quality can be realized. Furthermore, since a predicted temperature is corrected by the correction value CAL indicating an error between a measured temperature and a predicted temperature in a steady state of the head temperature (S155, S505, S585), the head temperature can be more accurately predicted.

Since the detailed arrangement of this embodiment is the same as that of the ninth embodiment, a description thereof will be omitted.

In this embodiment, the correction value CAL of the temperature prediction table is updated during only the paper feed/discharge operation of a recording medium. This is because, in addition to the steady state of the head temperature described above, since the paper feed/discharge operation of a recording medium requires a time of several seconds, the correction value CAL can be updated without influencing a recording time as long as control can be made within this time. More specifically, the temperature of the head chip is measured several times, thus preventing a detection error due to noise. In this embodiment, correction is performed once per paper feed/discharge operation. Alternatively, correction (prediction→measurement→correction) may be repeated a plurality of during a single paper feed/discharge operation, thus improving the precision of the correction value CAL.

A method of repeating correction until the correction value CAL is converged to a predetermined value may be employed. The correction timing is not limited to that during a paper feed/discharge operation, but may be set before or during a print operation of each line.

In this embodiment, the correction value CAL disappears when the power supply is turned off. However, the correction value may be stored in, e.g., a programmable nonvolatile storage medium (e.g., an EEPROM). Alternatively, the temperature prediction table itself may be allocated on a nonvolatile storage medium, and may be rewritten in every correction.

In this embodiment, the correction value "CAL" is calculated by (CAL=sensor value/predicted value "β"). However, the correction value may be calculated by other calculation means. Similarly, the predicted temperature of the head chip is calculated by (β=β*CAL) in this embodiment, but may be calculated by other calculation means.

As described above, according to this embodiment, the recording apparatus comprises a head temperature measurement means for measuring the temperature of a recording head, a surrounding temperature measurement means four measuring the surrounding temperature, a temperature calculation means for calculating a variation in temperature of the recording head, and a control means for controlling the recording head on the basis of the calculation result. Therefore, the following advantages can be provided:

① control can be made in real time without a response delay time in measurement of the head temperature;

② accumulation of a prediction error of the head temperature can be prevented; and ③ fuzzy control can be made to automatically improve prediction precision as the apparatus is used.

The temperature prediction described in the tenth embodiment can be applied to each of the third to eighth embodiments described previously like in the ninth embodiment.

(Eleventh Embodiment)

In this embodiment, a temperature sensor is provided for a recording head, and a head temperature is predicted with reference to the temperature detected by the temperature sensor in consideration of a predicted variation in temperature. The arrangement of this embodiment is the same as that shown in FIGS. 24 and 25 described in the tenth embodiment.

According to this embodiment, a future temperature can be predicted from a predicted print ratio, thus preventing a trouble caused by a time delay in temperature detection. Since response time characteristics in temperature control can be improved, ink ejection can be stabilized.

The temperature prediction described in the eleventh embodiment can be applied to each of the third to eighth embodiments described previously like in the ninth embodiment.

When restoration control, the number of times of pre-ejection, a wiping timing, and a pre-ejection timing are set in advance, control can be performed in correspondence with a predicted head temperature, and response characteristics can be further improved as compared to control that is performed while predicting a head temperature.

This embodiment can also be applied to a case wherein a sub-heater is controlled based on the print ratio. When a future temperature predicted from the current head temperature and a future print ratio is lower than an ink ejection standard temperature (23° C.), the ON time of the sub-heater is controlled according to the difference between the two temperatures so as to always obtain a constant head temperature, thus stabilizing ejection. At this time, a time shown in Table 3 is used as the ON time of the sub-heater according to the difference between the predicted future temperature and the ink ejection standard temperature. Since the ON time of the sub-heater is controlled beforehand, a control time delay at that time can be avoided, and control having good response characteristics can be realized.

When the print ratio changes abruptly, even when the temperature is detected in real time to control the sub-heater, adequate control cannot be performed since the influence of a time delay is considerable. However, when a future head temperature is predicted from a future print ratio, the ON time of the sub-heater is controlled beforehand to be able to follow an abrupt change in print ratio. Even when the print ratio changes abruptly, stable ejection can be assured.

In each of the above embodiments, the energization time is used as an index of an energy to be applied to head. However, the present invention is not limited to this. For example, when no PWM control is performed, or when no high-precision temperature prediction is required, the number of print dots may be simply used. Furthermore, when the print duty does not suffer from a large variation, a print time and a non-print time may be used.

The present invention brings about excellent effects particularly in a recording head and a recording device of the ink jet system using a thermal energy among the ink jet recording systems.

As to its representative construction and principle, for example, one practiced by use of the basic principle disclosed in, for instance, U.S. Pat. Nos. 4,723,129 and 4,740,796 is preferred. The above system is applicable to either one of the so-called on-demand type and the continuous type. Particularly, the case of the on-demand type is effective because, by applying at least one driving signal which gives rapid temperature elevation exceeding mucleate boiling corresponding to the recording information on electrothermal converting elements arranged in a range corresponding to the sheet or liquid channels holding liquid (ink), a heat energy is generated by the electrothermal converting elements to effect film boiling on the heat acting surface of the recording head, and consequently the bubbles within the liquid (ink) can be formed in correspondence to the driving signals one by one. By discharging the liquid (ink) through a discharge port by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in accordance with characteristics. As the driving signals of such pulse shapes, the signals as disclosed in U.S. Pat. Nos. 4,463,359 and 4,345,262 are suitable. Further excellent recording can be performed by using the conditions described in U.S. Pat. No. 4,313,124 of the invention concerning the temperature elevation rate of the above-mentioned heat acting surface.

As a construction of the recording head, in addition to the combined construction of a discharging orifice, a liquid channel, and an electrothermal converting element (linear liquid channel or right angle liquid channel) as disclosed in the above specifications, the construction by use of U.S. Pat. Nos. 4,558,333 and 4,459,600 disclosing the construction having the heat acting portion arranged in the flexed region is also included in the invention. The present invention can be also effectively constructed as disclosed in Japanese Laid-Open Patent Application No. 59-1238461 which discloses the construction using a slit common to a plurality of electrothermal converting elements as a discharging portion of the electrothermal converting element or Japanese Laid-Open Patent Application No. 59-1238461 which discloses the construction having the opening for absorbing a pressure wave of a heat energy corresponding to the discharging portion.

Further, as a recording head of the full line type having a length corresponding to the maximum width of a recording medium which can be recorded by the recording device, either the construction which satisfies its length by a combination of a plurality of recording heads as disclosed in the above specifications or the construction as a single recording head which has integrally been formed can be used. The present invention can exhibit the effects as described above more effectively.

In addition, the invention is effective for a recording head of the freely exchangeable chip type which enables electrical connection to the main device or supply of ink from the main device by being mounted onto the main device, or for the case by use of a recording head of the cartridge type provided integratedly on the recording head itself.

It is also preferable to add a restoration means for the recording head, preliminary auxiliary means, and the like provided as a construction of the recording device of the invention because the effect of the invention can be further stabilized. Specific examples of them may include, for the recording head, capping means, cleaning means, pressurization or aspiration means, and electrothermal converting elements or another heating element or preliminary heating means according to a combination of them. It is also effective for performing a stable recording to realize the preliminary mode which executes the discharging separately from the recording.

As a recording mode of the recording device, further, the invention is extremely effective for not only the recording mode of only a primary color such as black or the like but also a device having at least one of a plurality of different colors or a full color by color mixing, depending on whether the recording head may be either integrally constructed or combined in plural number.

What is claimed is:

1. A recording apparatus comprising:

a recording head for performing a recording operation by ejecting an ink from an ejection port using a heat energy of a driving signal;

drive means for supplying the driving signal to said recording head;

ejection quantity control means for controlling an ink ejection quantity ejected from the ejection port by changing the driving signal to be supplied to said recording head;

temperature measurement means for measuring a surrounding temperature;

temperature variation calculation means for calculating a variation in temperature of said recording head on the basis of a thermal time constant of said recording head and an energy of the driving signal supplied to said recording head during unit time; and presumption means for presuming the temperature of said recording head on the basis of the variation in temperature calculated by said temperature variation calculation means, and the surrounding temperature measured by said temperature measurement means, wherein said ejection quantity control means controls the ink ejection quantity by changing the driving signal on the basis of the presumed temperature presumed by said presumption means, and said temperature variation calculation means calculates a variation in temperature of said recording head on the basis of the driving signal changed by said ejection quantity control means.

2. An apparatus according to claim 1, wherein the driving signal comprises a pre-heat pulse and a main heat pulse, and the main pulse and the pre-heat pulse are so arranged as to have an interval therebetween.

3. An apparatus according to claim 2, wherein said ejection quantity control means changes a pulse width of the pre-heat pulse on the basis of the presumed temperature.

4. An apparatus according to claim 1, wherein said recording head causes a change in state in an ink by the heat energy, and ejects the ink on the basis of the change in state.

5. An apparatus according to claim 1, wherein said temperature variation calculation means comprises a matrix table indicating a variation in temperature per unit time determined on the basis of a thermal constant of said recording head and an energy of the driving signal supplied to said recording head during unit time.

6. An apparatus according to claim 1, wherein said apparatus is incorporated in a facsimile machine.

7. An apparatus according to claim 1, wherein said apparatus is incorporated in a copying machine.

8. An apparatus according to claim 1, wherein said apparatus is incorporated in terminal equipment of a computer.

9. A recording apparatus comprising:

a recording head for performing a recording operation by ejecting an ink from an ejection port using a heat energy of a driving signal;

drive means for supplying the driving signal to said recording head;

ejection quantity control means for controlling an ink ejection quantity ejected from the ejection port by changing the driving signal to be supplied to said recording head;

temperature measurement means for measuring a surrounding temperature;

temperature variation calculation means for calculating a variation in temperature of said recording head on the basis of a thermal time constant of said recording head and an energy supplied to said recording head during a reference period; and prediction means for predicting a future temperature of said recording head on the basis of the variation in temperature calculated by said temperature variation calculation means and the surrounding temperature measured by said temperature measurement means, wherein said ejection quantity control means controls the ink ejection quantity by changing the driving signal on the basis of the predicted temperature predicted by said prediction means, and said temperature variation calculation means calculates a variation in temperature of said recording head on the basis of the driving signal changed by said ejection quantity control means.

10. An apparatus according to claim 9, wherein the driving signal comprises a pre-heat pulse and a main pulse, and the main pulse and the pre-heat pulse are so arranged as to have an interval therebetween.

11. An apparatus according to claim 10, wherein said ejection quantity control means changes a pulse width of the pre-heat pulse on the basis of the predicted temperature.

12. An apparatus according to claim 9, wherein said recording head causes a change in state in the ink by the heat energy, and ejects the ink on the basis of the change in state.

13. An apparatus according to claim 9, wherein said temperature variation calculation means comprises a matrix table indicating a variation in temperature per the reference period determined on the basis of the thermal time constant of said recording head and an energy of the driving signal being supplied to said recording head during the reference period.

14. An apparatus according to claim 9, wherein said apparatus is incorporated in a facsimile machine.

15. An apparatus according to claim 9, wherein said apparatus is incorporated in a copying machine.

16. An apparatus according to claim 9, wherein said apparatus is incorporated in terminal equipment of a computer.

17. A recording apparatus comprising:

a recording head for performing a recording operation by ejecting an ink from an ejection port using a heat energy of a driving signal;

drive means for supplying the driving signal to said recording head;

temperature measurement means for measuring a surrounding temperature;

temperature calculation means for calculating a variation in temperature of said recording head on the basis of a thermal time constant of said recording head and an energy of the driving signal supplied to said recording head;

head temperature measurement means for measuring a temperature of said recording head;

detection means for detecting a difference between the variation in temperature of said recording head calculated by said temperature calculation means, and a variation in temperature of said recording head measured by said head temperature measurement means;

correction means for correcting calculations of said temperature calculation means according to the difference;

presumption means for presuming the temperature of said recording head on the basis of the variation in temperature calculated by said temperature calculation means or the corrected calculation by said correction means, and the surrounding temperature measured by said temperature measurement means; and ejection quantity control means for controlling an ink ejection quantity by changing the driving signal to be supplied to said recording head on the basis of the presumed temperature presumed by said presumption means.

18. An apparatus according to claim 17, wherein the driving signal comprises a pre-heat pulse and a main pulse, and the main pulse and the pre-heat pulse are so arranged as to have an interval therebetween.

19. An apparatus according to claim 18, wherein said ejection quantity control means changes a pulse width of the pre-heat pulse on the basis of the presumed temperature.

20. An apparatus according to claim 17, wherein said recording head causes a change in state in the ink by the heat energy, and ejects the ink on the basis of the change in state.

21. An apparatus according to claim 17, wherein said temperature calculation means comprises a matrix table indicating a variation in temperature per unit time determined on the basis of a thermal constant of said recording head and an energy of the driving signal supplied to said recording head during unit time.

22. An apparatus according to claim 17, wherein said apparatus is incorporated in a facsimile machine.

23. An apparatus according to claim 17, wherein said apparatus is incorporated in a copying machine.

24. An apparatus according to claim 17, wherein said apparatus is incorporated in terminal equipment of a computer.

25. A recording apparatus comprising:

a recording head for performing a recording operation by ejecting an ink from an ejection port using a heat energy of a driving signal;

drive means for supplying the driving signal to said recording head;

temperature measurement means for measuring a surrounding temperature;

temperature calculation means for calculating a variation in temperature of said recording head on the basis of a thermal time constant of said recording head and an energy of the driving signal supplied to said recording head;

first presumption means for presuming the temperature of said recording head on the basis of the variation in temperature calculated by said temperature calculation means, and the surrounding temperature measured by said temperature measurement means;

head temperature measurement means for measuring a temperature of said recording head;

detection means for detecting a difference between the head temperature presumed by said first presumption means for presuming the temperature of said recording head, and a head temperature measured by said head temperature measurement means;

correction means for correcting calculations of said temperature calculation means according to the difference;

second presumption means for presuming the temperature of said recording head on the basis of the corrected calculations of said correction means, and the surrounding temperature measured by said temperature measurement means; and ejection quantity control means for controlling an ink ejection quantity by changing the driving signal to be supplied to said recording head on the basis of the presumed temperature presumed by said first or second presumption means.

26. An apparatus according to claim 25, wherein the driving signal comprises a pre-heat pulse and a main pulse, and the main pulse and the pre-heat pulse are so arranged as to have an interval therebetween.

27. An apparatus according to claim 26, wherein said ejection quantity control means changes a pulse width of the pre-heat pulse on the basis of the presumed temperature.

28. An apparatus according to claim 25, wherein said recording head causes a change in state in the ink by the heat energy, and ejects the ink on the basis of the change in state.

29. An apparatus according to claim 25, wherein said temperature calculation means comprises a matrix table indicating a variation in temperature per unit time determined on the basis of a thermal constant of said recording head and an energy of the driving signal supplied to said recording head during unit time.

30. An apparatus according to claim 25, wherein said apparatus is incorporated in a facsimile machine.

31. An apparatus according to claim 25, wherein said apparatus is incorporated in a copying machine.

32. An apparatus according to claim 25, wherein said apparatus is incorporated in terminal equipment of a computer.

33. A recording apparatus comprising:

a recording head for performing a recording operation by ejecting an ink from an ejection port using a heat energy of a driving signal;

drive means for supplying the driving signal to said recording head;

temperature measurement means for measuring a surrounding temperature;

temperature calculation means for calculating a variation in temperature of said recording head on the basis of a thermal time constant of said recording head and an energy of the driving signal supplied to said recording head;

presumption means for presuming the temperature of said recording head on the basis of the variation in temperature calculated by said temperature calculation means, and the surrounding temperature measured by said temperature measurement means; and ejection quantity control means for controlling an ink ejection quantity, wherein said ejection quantity control means is operable in a first mode for controlling an ink ejection quantity by changing the temperature of said recording head and a second mode for controlling an ink ejection quantity by changing the driving signal to be supplied to said recording head, and wherein in the first mode, a difference between the temperature presumed by said presumption means and a target temperature is controlled to be minimized, and in the second mode, the driving signal to be supplied to said recording head is changed on the basis of the difference.

34. An apparatus according to claim 33, wherein the driving signal comprises a pre-heat pulse and a main pulse, and the main pulse and the pre-heat pulse are so arranged as to have an interval therebetween.

35. An apparatus according to claim 34, wherein said ejection quantity control means changes a pulse width of the pre-heat pulse on the basis of the presumed temperature.

36. An apparatus according to claim 33, wherein said recording head causes a change in state in the ink by the heat energy, and ejects the ink on the basis of the change in state.

37. An apparatus according to claim 33, wherein said temperature calculation means comprises a matrix table indicating a variation in temperature per unit time determined on the basis of a thermal constant of said recording head and an energy of the driving signal supplied to said recording head during unit time.

38. An apparatus according to claim 33, wherein said apparatus is incorporated in a facsimile machine.

39. An apparatus according to claim 33, wherein said apparatus is incorporated in a copying machine.

40. An apparatus according to claim 33, wherein said apparatus is incorporated in terminal equipment of a computer.

41. A recording apparatus comprising:

a recording head for performing a recording operation by ejecting an ink from an ejection port using a heat energy of a driving signal;

drive means for supplying the driving signal to said recording head;

temperature measurement means for measuring a surrounding temperature;

temperature calculation means for calculating a variation in temperature of said recording head on the basis of a thermal time constant of said recording head and an energy of the driving signal being supplied to said recording head during a reference period;

prediction means for predicting a future temperature of said recording head on the basis of the variation in temperature calculated by said temperature calculation means and the surrounding temperature measured by said temperature measurement means; and ejection quantity control means for controlling an ink ejection quantity, wherein said ejection quantity control means is operable in a first mode for controlling the ink ejection quantity by changing the temperature of said recording head and a second mode for controlling the ink ejection quantity by changing the driving signal to be supplied to said recording head, and wherein in the first mode, a difference between the future temperature predicted by said prediction means and a target temperature is controlled to be minimized, and in the second mode, the driving signal to be supplied to said recording head is changed on the basis of the difference.

42. An apparatus according to claim 41, wherein the driving signal comprises a pre-heat pulse and a main pulse, and the main pulse and the pre-heat pulse are so arranged as to have an interval therebetween.

43. An apparatus according to claim 42, wherein said ejection quantity control means changes a pulse width of the pre-heat pulse on the basis of the predicted temperature.

44. An apparatus according to claim 41, wherein said recording head causes a change in state in the ink by the heat energy, and ejects the ink on the basis of the change in state.

45. An apparatus according to claim 41, wherein said temperature calculation means comprises a matrix table indicating a variation in temperature per the reference period determined on the basis of the thermal time constant of said recording head and an energy of the driving signal being supplied to said recording head during the reference period.

46. An apparatus according to claim 41, wherein said apparatus is incorporated in a facsimile machine.

47. An apparatus according to claim 41, wherein said apparatus is incorporated in a copying machine.

48. An apparatus according to claim 41, wherein said apparatus is incorporated in terminal equipment of a computer.

* * * * *

UNITED STATES PATENT AND TRADEMARK OFFICE

CERTIFICATE OF CORRECTION

PATENT NO. : 5,559,535 Page 1 of 2

DATED : September 24, 1996

INVENTOR(S) : Naoji OTSUKA, et al.

It is certified that error appears in the above-indentified patent and that said Letters Patent is hereby corrected as shown below:

AT [56] References Cited - FOREIGN PATENT DOCUMENTS:

"3-935661" should read --3935661--.

COLUMN 13:

Line 60, "shogun" should read --shown--.

COLUMN 19:

Line 17, "storage arithmetic" should read --storage•arithmetic--;

Line 23, "paper, powder" should read --paper powder,--.

COLUMN 21:

Line 11, "coupled.," should read --coupled,--.

COLUMN 25:

Line 19, "AS" should read --A8--.

UNITED STATES PATENT AND TRADEMARK OFFICE

CERTIFICATE OF CORRECTION

PATENT NO. : 5,559,535 Page 2 of 2

DATED : September 24, 1996

INVENTOR(S) : Naoji OTSUKA, et al.

It is certified that error appears in the above-indentified patent and that said Letters Patent is hereby corrected as shown below:

COLUMN 29:

Line 40, "of" should read --of times--.

COLUMN 31:

Line 8, "mucleate" should read --nucleate--;
Line 38, "59-1238461" should read --59-123670--;
Line 42, "59-1238461" should read --59-138461--.

Signed and Sealed this

Eleventh Day of March, 1997

*Attest:*

*Attesting Officer*

BRUCE LEHMAN

*Commissioner of Patents and Trademarks*